US011266193B2

(12) United States Patent
Bowman

(10) Patent No.: US 11,266,193 B2
(45) Date of Patent: Mar. 8, 2022

(54) HEADWEAR WITH TEMPERATURE CONTROL APPARATUS

(71) Applicant: Peter Bowman, St. Augustine, FL (US)

(72) Inventor: Peter Bowman, St. Augustine, FL (US)

( * ) Notice: Subject to any disclaimer, the term of this patent is extended or adjusted under 35 U.S.C. 154(b) by 0 days.

(21) Appl. No.: 17/143,050

(22) Filed: Jan. 6, 2021

(65) Prior Publication Data

US 2021/0337907 A1 Nov. 4, 2021

Related U.S. Application Data

(60) Provisional application No. 63/017,476, filed on Apr. 29, 2020.

(51) Int. Cl.

| | |
|---|---|
| ***A42B 1/00*** | (2021.01) |
| ***A42B 1/008*** | (2021.01) |
| ***A42B 1/04*** | (2021.01) |

(52) U.S. Cl.

CPC ..... *A42B 1/008* (2013.01); *A42B 1/04* (2013.01)

(58) Field of Classification Search

CPC ..... A42B 1/008; A42B 1/04

See application file for complete search history.

(56) References Cited

U.S. PATENT DOCUMENTS

| | | | | |
|---|---|---|---|---|
| 4,204,543 | A | 5/1980 | Henderson | |
| 4,551,857 | A | 11/1985 | Galvin | |
| 4,776,042 | A * | 10/1988 | Hanson | A42B 1/008 2/171 |
| 4,805,619 | A * | 2/1989 | Swearingen | A61F 7/103 383/901 |
| 5,054,122 | A | 10/1991 | Sher | |
| 5,197,292 | A | 3/1993 | McPherson | |
| 5,305,470 | A * | 4/1994 | McKay | A41D 20/005 2/170 |
| 5,365,607 | A | 11/1994 | Benevento et al. | |
| 5,469,579 | A | 11/1995 | Tremblay et al. | |
| 5,557,807 | A | 9/1996 | Hujar et al. | |
| 5,605,144 | A | 2/1997 | Simmons et al. | |
| 5,715,533 | A | 2/1998 | Stein | |
| 5,887,284 | A | 3/1999 | Simmons | |
| 6,681,590 | B1 | 1/2004 | Jones | |
| 6,857,134 | B1 * | 2/2005 | Cowell | A42C 5/04 2/209.13 |
| 7,008,445 | B2 | 3/2006 | Lennox | |
| 7,143,451 | B2 | 12/2006 | Lundgren | |
| 7,921,473 | B1 | 4/2011 | Winters | |
| 8,087,254 | B2 | 1/2012 | Arnold | |

(Continued)

OTHER PUBLICATIONS

International Search Report from PCT/US2021/029461 dated Jul. 27, 2021.

*Primary Examiner* — Khaled Annis

(74) *Attorney, Agent, or Firm* — Wilson Dutra, PLLC; Camille A. Wilson

(57) ABSTRACT

The present disclosure provides an exemplary for a temperature control apparatus (TCA) that may be applied under variations of headwear to keep the head and overall body temperature cooler. In some implementations, the cooling material may be stored in a secondary temperature control system to keep the cooling materials as cool as possible and as durable as possible. In some embodiments, different TCA may exist for different types of headwear and usages by the user.

19 Claims, 22 Drawing Sheets

(56) References Cited

U.S. PATENT DOCUMENTS

| | | | | |
|---|---|---|---|---|
| 8,117,677 | B2 | 2/2012 | Toth | |
| 8,166,772 | B2 | 5/2012 | Cho | |
| 8,658,943 | B1 | 2/2014 | Larsen et al. | |
| 9,775,396 | B1 * | 10/2017 | Olivares Velasco | G16H 40/67 |
| 2004/0244412 | A1 * | 12/2004 | Trinh | A61F 7/103 62/530 |
| 2005/0268382 | A1 * | 12/2005 | Epling | A42C 5/04 2/411 |
| 2006/0005291 | A1 * | 1/2006 | Bedford | A42B 3/285 2/7 |
| 2008/0040831 | A1 * | 2/2008 | Nilforushan | A41D 13/0058 2/69 |
| 2009/0205107 | A1 | 8/2009 | Coba | |
| 2012/0144555 | A1 * | 6/2012 | Panicali | A42B 1/008 2/171.2 |
| 2013/0152274 | A1 | 6/2013 | Welch | |
| 2013/0296986 | A1 | 11/2013 | Dukes | |
| 2014/0298567 | A1 * | 10/2014 | Potts | A42B 1/008 2/171.2 |
| 2014/0303699 | A1 * | 10/2014 | Wahl | A42B 1/008 607/110 |
| 2014/0358206 | A1 * | 12/2014 | Hirokane | A61F 7/03 607/109 |
| 2016/0058084 | A1 | 3/2016 | Stevenson | |
| 2016/0219965 | A1 * | 8/2016 | Sansone | A42B 1/008 |
| 2016/0331581 | A1 | 11/2016 | Kozloski et al. | |
| 2017/0224530 | A1 | 8/2017 | Farrago | |
| 2018/0303182 | A1 * | 10/2018 | Smith | A42C 5/04 |
| 2019/0307604 | A1 | 10/2019 | Ainslie | |
| 2020/0229526 | A1 * | 7/2020 | Santos | A42B 1/008 |
| 2020/0345094 | A1 | 11/2020 | Waters | |

* cited by examiner

400

500

501

502

800

1100

1100

1200

1300

1500

1500

2120

HEADWEAR WITH TEMPERATURE CONTROL APPARATUS

CROSS REFERENCE

This application claims priority to and the full benefit of U.S. Provisional Patent Application Ser. No. 63/017,476, filed Apr. 29, 2020, and titled "HEADWEAR WITH TEMPERATURE CONTROL APPARATUS", the entire contents of which are incorporated in this application by reference.

BACKGROUND OF THE DISCLOSURE

Hats date back to 3200 B.C. in Thebes, Egypt, where drawings were sketched on tombs, featuring Egyptians wearing a type of hat intended to keep their heads cool from extreme African temperatures. Today, a range of headwear exists that offer a variety of benefits. Some ceremonial headwear allows a user to identify oneself as a member of an organization or fan base. Others wear specific headwear to abide by laws and regulations while riding bikes or playing contact sports, such as football or hockey. Most commonly, headwear provides basic protection from sun exposure, such as against ultraviolet (UV) rays and heat.

While hats may properly block a majority of UV rays, these hats typically do not lower body temperature. Instead, hats typically trap heat within the hat, raising the wearer's overall body temperature. Recently, sports-based companies have developed technology to create hats that may block out UV rays while keeping the wearer cool. However, most of these cooler options include some variety of mesh designs, which still allow the UV rays to penetrate the hat and make their way to the face and head.

Hats that are not specifically designed to keep someone cool will typically not do so. Although some hats inherently keep the wearer's head cool by limiting sun exposure and collecting perspiration, most headwear actually makes users feel warmer and may cause them to retain heat that may typically escape without putting on headwear.

SUMMARY OF THE DISCLOSURE

What is needed is a practical solution to keep a user cool while wearing headwear, combining the benefits of headwear with some way of controlling the wearer's overall body temperature, whether that be warmer or cooler. Accordingly, the present disclosure relates to headwear that may comprise or integrate with a temperature control apparatus (TCA). In some aspects, a TCA may comprise a temperature-retaining material, such as a gel, foam, liquid, or solid. In some embodiments, a TCA may be inserted into headwear to allow for cooling or heating, based on the needs of the user.

In some implementations, a TCA may be removable, which may allow for easy cleaning separate from the headwear, which may need different cleaning techniques. In some aspects, the TCA may be placed in a secondary temperature-control system, such as a refrigerator, oven, microwave, freezer, or ice bath. In some embodiments, the TCA may be independently activated, such as through an internal mechanism or a chemical reaction. In some aspects, the TCA may fit into a range of headwear, such as ball caps, visors, football helmets, riding helmets, fishing hats, or wide-brimmed hats.

The present disclosure relates to a headwear with temperature control a wearable apparel for removably wearing on a head of a user, where the wearable apparel may comprise a head covering that covers at least a portion of the head when the wearable apparel may be worn, an opening to receive the head into the head covering, and a securing mechanism that secures the wearable apparel to the head, and a temperature control apparatus integrated with at a least a portion of the head covering and proximate to the head when worn, where the temperature control apparatus may be configured to control a temperature of the head.

In some embodiments, the headwear where the temperature control apparatus may comprise a temperature-retaining material distributed throughout the wearable apparel. In some implementations, the temperature-retaining material may be activated by placement of the headwear in a freezer. In some aspects, the temperature-retaining material may be activated by pressure caused when the headwear may be worn on the head. In some embodiments, the wearable apparel may comprise a ball cap. In some implementations, the wearable apparel may comprise a skull cap. In some aspects, the skull cap may be insertable into a secondary headwear.

In some embodiments, the secondary headwear may comprise protective headwear. In some implementations, the temperature control apparatus may comprise a packet of temperature-retaining material. In some aspects, the temperature control apparatus may comprise a plurality of insertable pads. In some embodiments, the temperature control apparatus may comprise an insertable strip may comprise a plurality of pockets of temperature-retaining material. In some implementations, the insertable strip may be customizable to fit a plurality of head sizes and headwear styles.

The present disclosure relates to a temperature control apparatus for use in headwear a temperature control apparatus configured to removably integrate with headwear, where headwear may comprise a wearable apparel for removably wearing on a head of a user, where when integration of the temperature control apparatus allows for temperature control of at least a portion of the head when the user wears the wearable apparel, and where the wearable apparel may comprise: a head covering that covers at least a portion of the head when the wearable apparel may be worn, an opening to receive the head into the head covering, and a securing mechanism that secures the wearable apparel to the head.

The temperature control apparatus may comprise an activation mechanism, where activation prompts temperature control. The present disclosure relates to a temperature control system for use in headwear. In some embodiments, the temperature control system may include a temperature control apparatus configured to removably integrate with headwear. In some implementations, headwear may comprise a wearable apparel for removably wearing on a head of a user, where when integration of the temperature control apparatus allows for temperature control of at least a portion of the head when the user wears the wearable apparel, and where the wearable apparel may comprise a head covering that covers at least a portion of the head when the wearable apparel may be worn, an opening to receive the head into the head covering, and a securing mechanism that secures the wearable apparel to the head.

In some embodiments, the wearable apparel may comprise a ball cap. In some implementations, the temperature control apparatus may comprise a plurality of insertable pads connectable to at least a portion of the wearable apparel. At least the portion of the wearable apparel may comprise hook and loop material, and each of the plurality of the insertable pads may comprise a hook and loop backing connectable to the hook and loop material. In some aspects, the temperature control apparatus may comprise an insertable headband, where when inserted into the wearable apparel, the temperature control apparatus wraps around a forehead of the user. In some embodiments, the insertable headband may be adjustable to one or both a headwear style and size of the head. Implementations of the described techniques may comprise hardware, a method or process, or computer software on a computer-accessible medium.

BRIEF DESCRIPTION OF THE DRAWINGS

The accompanying drawings that are incorporated in and constitute a part of this specification illustrate several embodiments of the disclosure and, together with the description, serve to explain the principles of the disclosure.

DETAILED DESCRIPTION

Figure 1A:
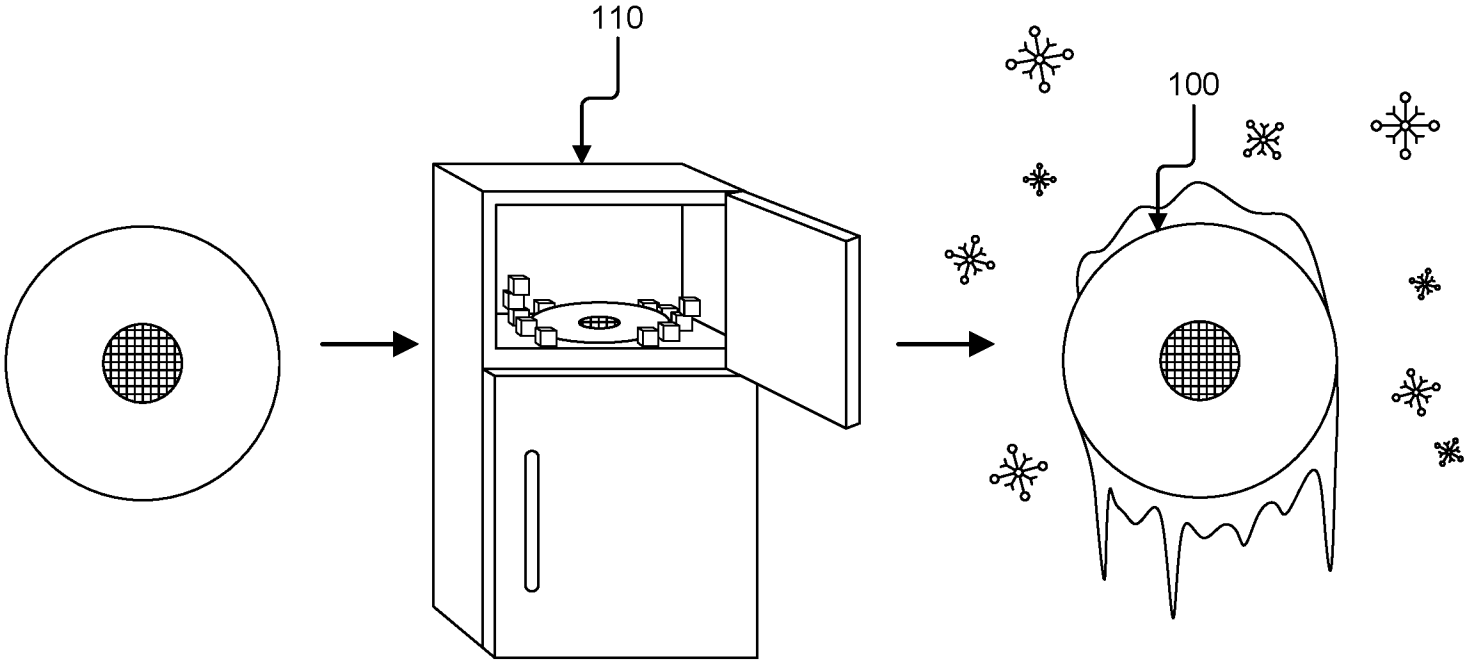
FIG. 1A illustrates a secondary temperature control system with exemplary TCA, according to some embodiments of the present disclosure.

The present disclosure provides generally for a temperature control apparatus (TCA) that may be used in unison with different headwear to keep the users' head cool while doing different activities. According to the present disclosure, the TCA may come in different versions for different headwear and different uses. In some embodiments, the user may customize the areas in which the cooling material may affect their head for personal preference.

In some implementations, different TCA may fit better with different headwear, and in some examples different TCA may last longer than other versions based on thickness, retaining material, type and any other non-limiting factors. In some aspects, the TCA may have different attachment mechanism that help adhere the TCA to the headwear.

In some embodiments, the TCA may have different types of cooling materials which may be used for different headwear and different types of the TCA. In some implementations, the cooling strips may work better than the cooling pods in certain headwear. In some aspects, a variation of the TCA may work better with one piece of headwear than another.

In some embodiments, a user may use any combination of the TCA and cooling material they like versus a specifically designed combination. This may be because the user is more comfortable using one combination of the TCA than the originally designed combination. In some implementations, the cooling material may condense and form to the particular helmet which the user may be using at the time while still being fully used to its capability.

In the following sections, detailed descriptions of examples and methods of the disclosure will be given. The description of both preferred and alternative examples, though thorough, are exemplary only, and it is understood to those skilled in the art that variations, modifications, and alterations may be apparent. It is therefore to be understood that the examples do not limit the broadness of the aspects of the underlying disclosure as defined by the claims.

Glossary

Headwear: as used herein refers to any apparel for use on the head. In some aspects, headwear may comprise a pliable material, such as typically associated with visors, sports caps, or beach hats. In some implementations, headwear may comprise a padding material or protective functionality, such as sports helmets, riding hats, or bicycle helmets.

Temperature Control Apparatus (TCA): as used herein refers to any apparatus that may allow for temperature control within headwear. In some aspects, a TCA may comprise a temperature-retaining material, such as thermal gels, thermal beads, or plastics, metals, or liquids as non-limiting examples In some aspects, headwear may comprise a TCA, such as may be integrated into the hat material or structure. In some embodiments, a TCA may be removable, wherein a user may add or remove the TCA from headwear as needed. In some implementations, a TCA may be placed in a secondary temperature-controlled system, such as a freezer, refrigerator, or microwave, which may place the TCA at a base temperature.

Figure 1B:
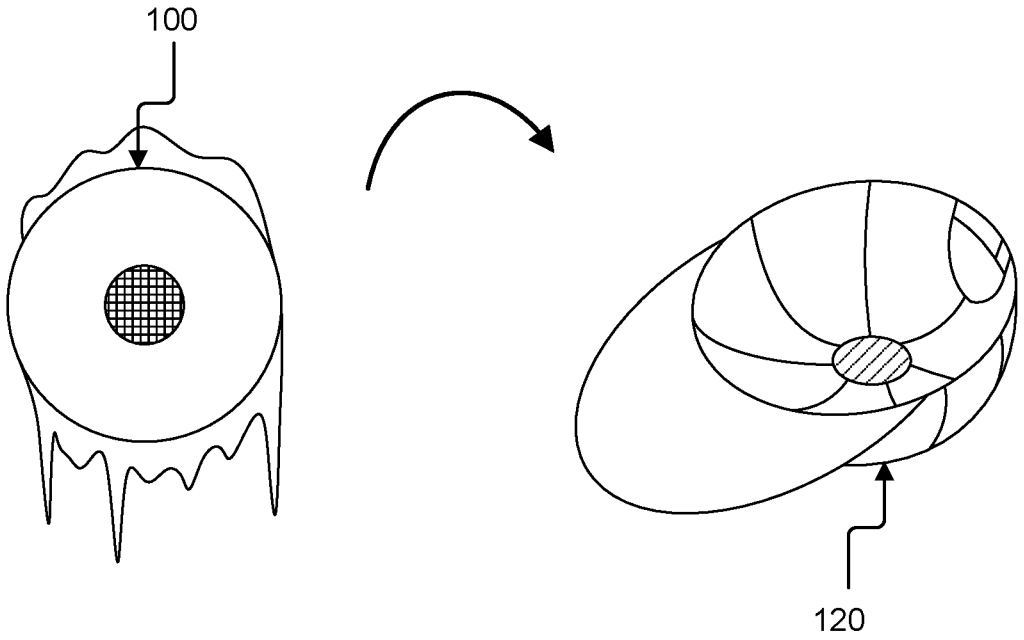
FIG. 1B illustrates headwear with exemplary TCA, according to some embodiments of the present disclosure.
Figure 1C:
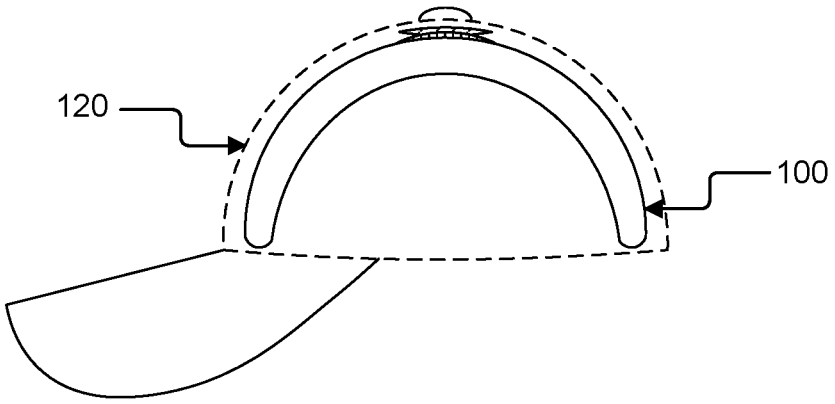
FIG. 1C illustrates headwear with exemplary TCA, according to some embodiments of the present disclosure.

Referring now to FIG. 1A, a secondary temperature control system with exemplary TCA 100 is illustrated. Referring now to FIG. 1B, headwear with exemplary TCA 100 is illustrated. Referring now to FIG. 1C, headwear 120 with exemplary TCA 100 is illustrated. In some embodiments, the TCA 100 may have a center attachment mechanism that may attach the device to different headwear 120. In some implementations, the attachment may be universally used for different types of headwear using the same attachment. For example, the attachment may be used for a bicycle helmet, a baseball cap, or a wide-brimmed hat, as non-limiting examples.

In some embodiments, the attachment for the TCA 100 may comprise a range of attachment mechanisms that may secure the TCA 100 onto the headwear 120. In some implementations, the TCA 100 may comprise a hook and loop attachment means that may stick to a complementary hook and loop pad within the headwear 120. In some aspects, the attachment may be a hook and loop pad that attaches the TCA 100 to the headwear 120. In some embodiments, the TCA 100 may extend to the edge of the headwear 120, which may allow for cooling throughout the user's head.

In some aspects, the TCA 100 may have a magnetic attachment system that may connect the device to the underside of the headwear 120. In some embodiments, the attachment mechanism may comprise a sticky adhesive that adheres the surfaces between the headwear 120 and the TCA 100. In some implementations, the attachment system may consist of complementary materials that can be attached to both the TCA 100 and the headwear 120. For example, the TCA 100 may comprise a thin silicone pad. The headwear 120 may comprise a similarly placed silicone pad, which may be textured, wherein placement of the TCA 100 within the headwear 120 may align the pads and limit slipping. In some embodiments, a silicone pad in a TCA 100 may provide sufficient friction to limit slipping of the TCA 100 within the headwear 120.

In some implementations, the attachment mechanism may be small or relatively small to the headwear 120 so that it is comfortable for the user to wear with the TCA 100 inserted in the headwear 120. In some aspects, a small attachment mechanism may allow for extended use because of increased comfort and better fit. In some implementations, the TCA 100 may fit almost flush with the headwear 120 because the attachment mechanism and temperature retaining material are low profile.

In some embodiments, the TCA 100 may be placed in a secondary temperature control system 110 to activate the temperature control system within the TCA 100. In some implementations, the secondary temperature control system 110 may be a microwave, freezer, ice bath, refrigerator, oven, or any other non-limiting example. In some aspects, the secondary temperature control system may not be required to activate the temperature control of the TCA 100. For example, the TCA 100 may comprise a temperature-retaining material that may be squeezed to activate a cooling or heating. In some embodiments, the temperature control for the TCA 100 may be enhanced when placed into a secondary temperature control system.

Figure 2A:
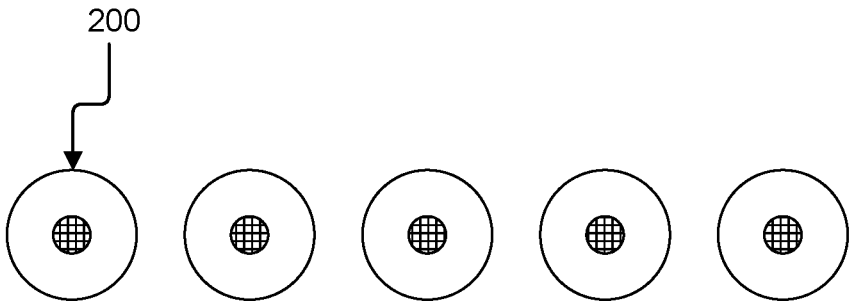
FIG. 2A illustrates exemplary TCA, according to some embodiments of the present disclosure.
Figure 2B:
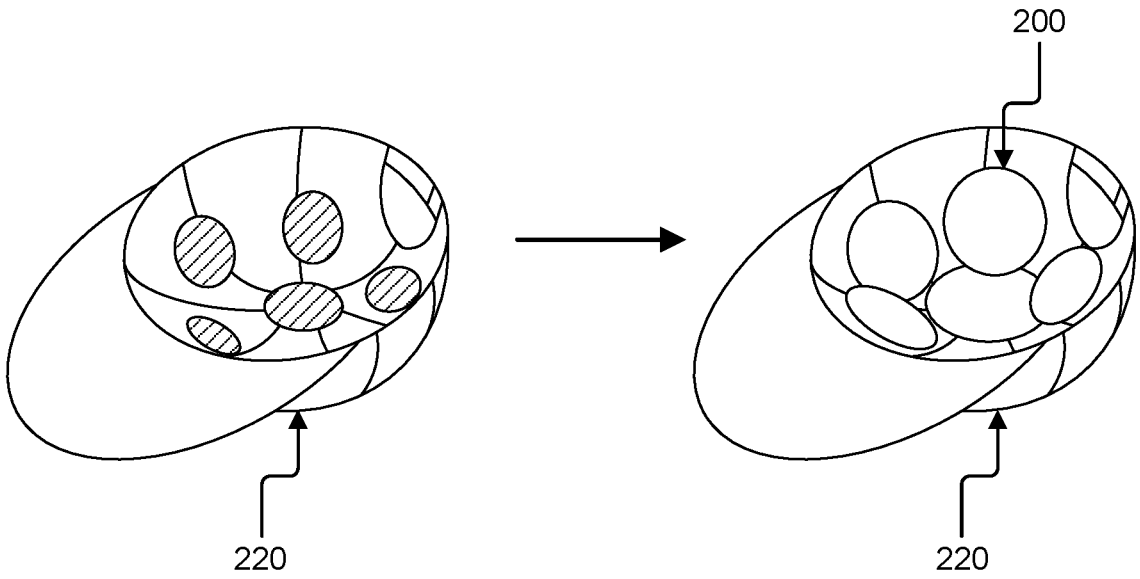
FIG. 2B illustrates headwear with exemplary TCA, according to some embodiments of the present disclosure.

Referring now to FIG. 2A, exemplary TCA 200 is illustrated. Referring now to FIG. 2B, headwear 220 with exemplary TCA 200 is illustrated. In some implementations, the smaller TCA 200 may allow for a more controlled placement within the headwear 200. In some aspects, the smaller TCA 200 may be interconnected, which may allow for limited placement within headwear 220. In some embodiments, each TCA 200 may be separate pieces, which may allow for custom placement within headwear 220. In some implementations, the TCA 200 may have individual cooling mechanisms in each unit.

In some embodiments, the TCA 200 may be placed anywhere on the underside of the headwear 220. In some implementations, the headwear 220 and TCA 200 may be equipped with any of the previously mentioned attachment mechanisms. In some aspects, the smaller TCA 200 may allow the user to place them selectively on the underside of the headwear 220. In some embodiments, the user may place the TCA 200 on different areas of the headwear 220 based on the comfort, fit or purpose desired by the user. For example, a user may prefer cooling around the edges of the headwear 220 and may insert TCA 200 in that target area. By way of another example, a user may be balding and prefer to cool a small bald spot near the crown of their head.

In some embodiments, the attachment mechanism on the underside of the headwear 220 may be comfortable for the user despite the TCA 200 not being attached on the underside. In some implementations, the attachment mechanism may be detached from the underside of the headwear 220 if the user decides the comfort level is not to their liking. In some aspects, the placement of the attachment mechanisms may be moved by the user if the original placement is not adequate or comfortable. For example, if the headwear 220 comprises a fitted ball cap, the area around the rim may be too snug to comfortably fit TCA 200.

Figure 3A:
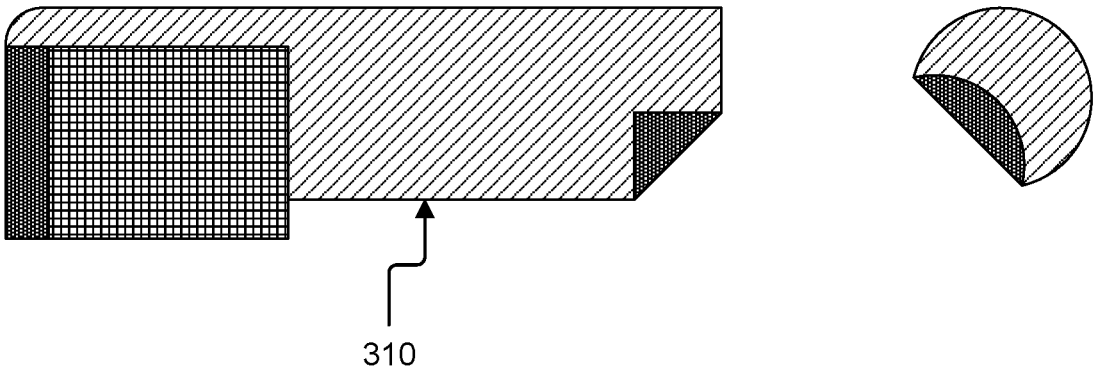
FIG. 3A illustrates exemplary attachment mechanism adapter, according to some embodiments of the present disclosure.
Figure 3B:
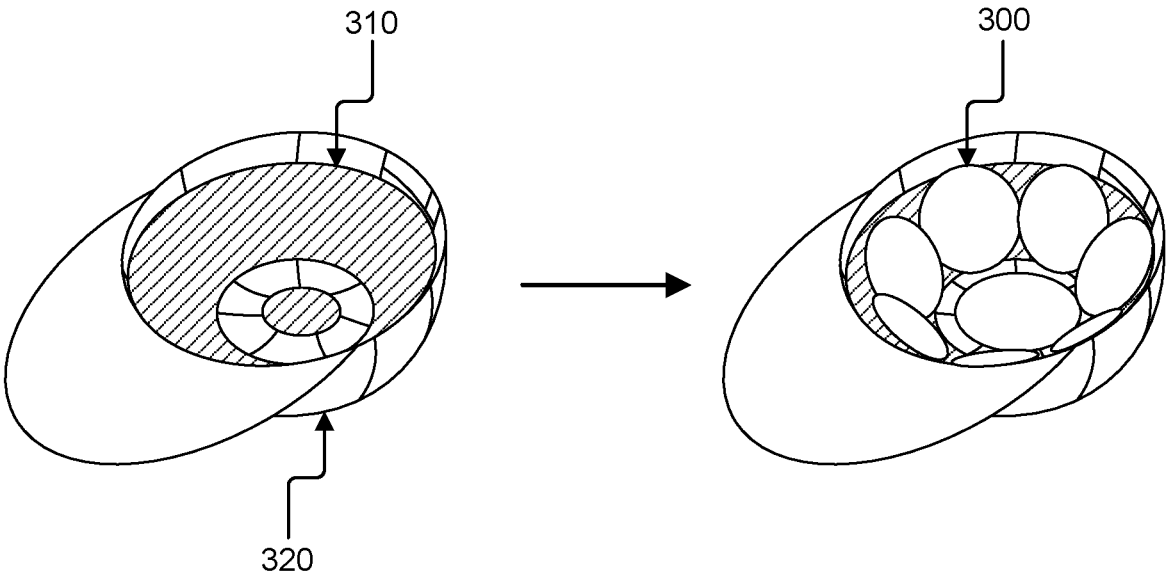
FIG. 3B illustrates headwear with exemplary TCA, according to some embodiments of the present disclosure.

Referring now to FIG. 3A, exemplary attachment mechanism 310 adapter is illustrated. Referring now to FIG. 3B, headwear 320 with exemplary TCA 300 is illustrated. In some embodiments, the attachment mechanism 310 may be inserted into the underside of the headwear 320. In some implementations, the length of the attachment mechanism 310 may be one fixed length to adjust to different types of headwear 320. In some aspects, the attachment mechanism 310 may come in pre-determined lengths based on the headwear 320. For example, the attachment mechanism 310 may come in youth, men's, and women's sizes, which may allow for different size ranges.

In some embodiments, the attachment mechanism 310 may consist of two different sides; one side may have the cooling mechanism and one side may have the attachment mechanism 310 that may connect to the underside of the headwear 320. In some implementations, the back side that connects to the underside may comprise hook and loop material or other attachment mechanism 310 to ensure the attachment mechanism 310 stays in place. In some aspects, the attachment mechanism 310 may be permanent to a specific headwear for the user based on the purpose. In some embodiments, the attachment mechanism 310 may be used around the outside of the headwear 320. In some implementations, the placement of the attachment mechanism 310 may be up to the discretion of the user and the purpose of the headwear 320.

In some embodiments, the TCA 300 may be placed throughout the attachment mechanism 310 on the underside of the headwear 320 as shown. In some implementations, the TCA 300 may be placed in convenient places for the best fit and comfortability for the user. In some aspects, the TCA 300 may comprise inserts that fit onto the attachment mechanism 310 or one singular insert that attaches based on the use and desire of the user.

In some embodiments, the TCA 300 may be placed in susceptible areas of the headwear 320 that may have overheating. In some implementations, the TCA 300 may comprise different types of pads that the user may align anywhere they would like based on their desire and use of the headwear 320. In some aspects, the TCA 300 may be removable, which may allow for separate cleaning. In some embodiments, a removable TCA 300 may allow for easy placement of the TCA 300 in a secondary temperature control system, such as a refrigerator or microwave.

In some aspects, the pads may comprise a fabric or protective lining that may limit any damage that may be caused from direct contact of the temperature-retaining material to the user's skin. In some implementations, the pads may be reversible, such as for different temperatures. For example, on one side, the liner may be thin for the cooling, and the other side may comprise a warm flannel lining.

Figure 4A:
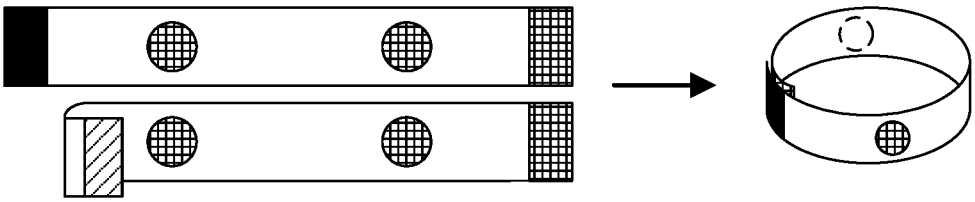
FIG. 4A illustrates exemplary TCA, according to some embodiments of the present disclosure.
Figure 4B:
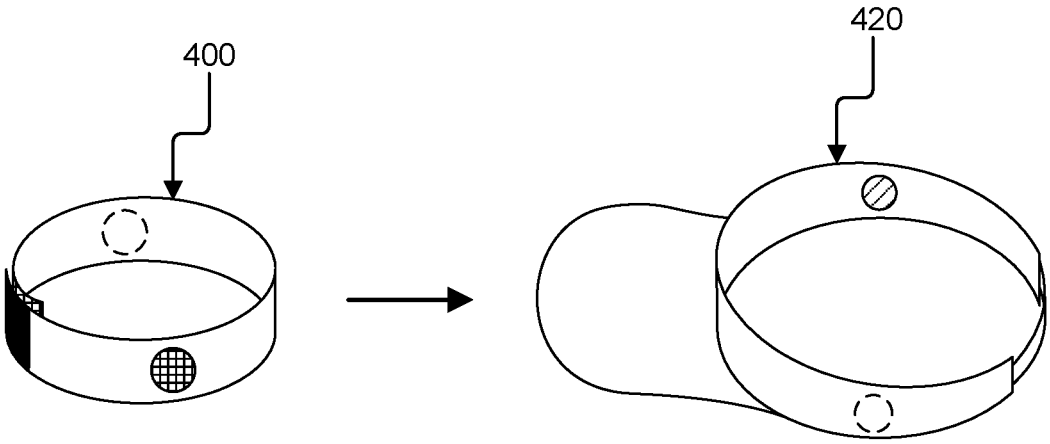
FIG. 4B illustrates headwear with exemplary TCA, according to some embodiments of the present disclosure.
Figure 4C:
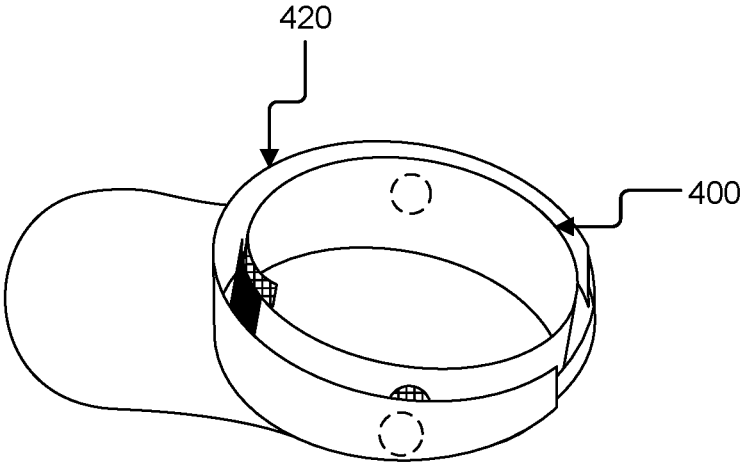
FIG. 4C illustrates headwear with exemplary TCA, according to some embodiments of the present disclosure.

Referring now to FIG. 4A, exemplary TCA 400 is illustrated. Referring now to FIG. 4B, headwear 420 with exemplary TCA 400 is illustrated. Referring now to FIG. 4C, headwear 420 with exemplary TCA 400 is illustrated. In some embodiments, the TCA 400 may come in a variation that may be used for headwear 420 that may not have a top portion. For example, these types of headwear 420 may include, but are not limited to, visors, patrol caps, combat helmets, and other non-limiting examples. In some implementations, the TCA 400 may comprise a series of temperature control pods wrapped around the base. In some aspects, the cooling pods may be moved throughout the TCA 400 by the user based on personal preference.

In some embodiments, the TCA 400 may comprise cooling portions rather than pods, and these portions may be activated separately based on the users' preferred setting. In some implementations, the TCA 400 may be rotated so the cooling portions may reach different portions of the head. In some aspects, the cooling portions may be removable and replaced with the cooling pods based on the preference of the user or the desired use of the headwear 420.

In some embodiments, the TCA 400 may allow for placement into a secondary temperature control system when removed from the headwear 420. In some implementations, the headwear 420 may not need to be placed into the secondary temperature control system with the TCA 400. In some aspects, the headwear 420 may be placed in the secondary temperature control system with the TCA 400 based on the users' discretion. In some embodiments, the TCA 400 may be inserted into the inside of a visor for a secure fit.

In some implementations, the TCA 400 may be worn like a headband separately from the headwear 420. In some aspects, the TCA 400 may have a special adhesive to allow for minimal movement and maximum-security while being worn actively as a headband. In some embodiments, the TCA 400 may be adjustable so that the user may wear it as a headband naturally and adjust to different size heads and haircuts depending on the user. In some implementations, the TCA 400 may be worn with different types of headwear other than just visors or headwear without tops.

Figure 5A:
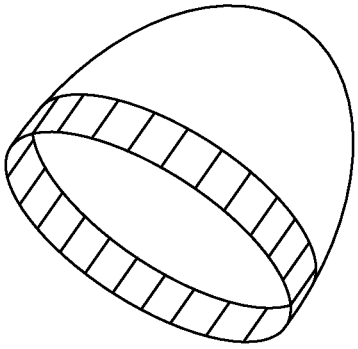
FIG. 5A illustrates exemplary TCA cap, according to some embodiments of the present disclosure.
Figure 5B:
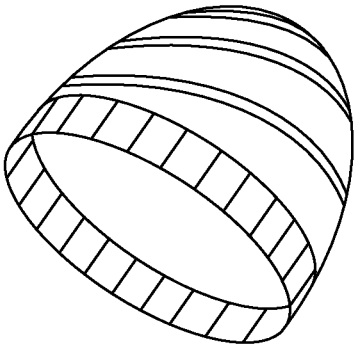
FIG. 5B illustrates exemplary TCA cap, according to some embodiments of the present disclosure.
Figure 5C:
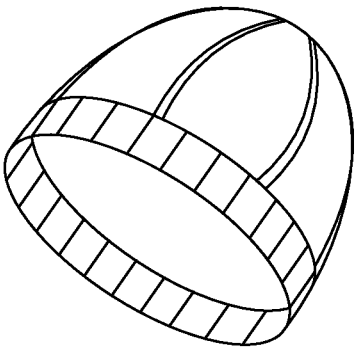
FIG. 5C illustrates exemplary TCA cap, according to some embodiments of the present disclosure.
Figure 5D:
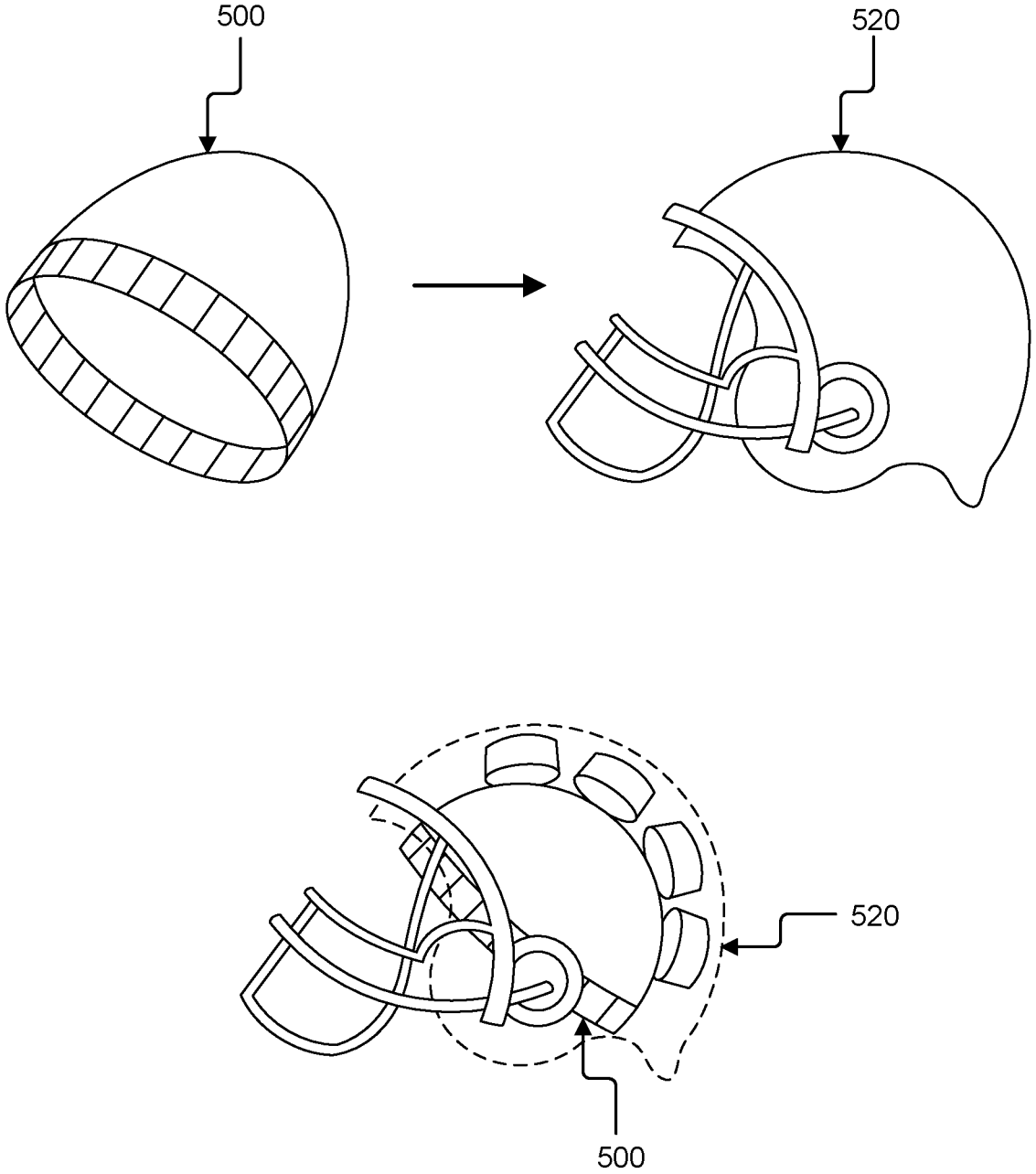
FIG. 5D illustrates headwear with exemplary TCA, according to some embodiments of the present disclosure.

Referring now to FIG. 5A, exemplary TCA cap 500 is illustrated. Referring now to FIG. 5B, exemplary TCA cap 501 is illustrated. Referring now to FIG. 5C, exemplary TCA cap 502 is illustrated. Referring now to FIG. 5D, headwear 500 with exemplary TCA 520 is illustrated. In some embodiments, this version of the TCA 500 may resemble a thinner version of a skull cap in order to fit under thicker headwear that may have padding. In some implementations, this version of the TCA 500 may fit under sporting helmets such as football helmets, motocross helmets, baseball helmets, or motor bike helmets, as non-limiting examples.

In some aspects, this version of the TCA 500 may have similar cooling pads throughout the device as previously stated in other figures. In some embodiments, there may exist different temperature control mechanisms, such as strips or lining of the TCA 500. In some implementations, the entire TCA 500 may comprise a temperature-retaining material to ensure that the TCA 500 retains as much cooling as possible. In some implementations, the TCA 500 may comprise an elastic band at the base to secure the device around the users' head. In some aspects, a TCA cap 501, 502 may comprise tubing or veins of temperature-retaining material, which may be cooled or heated, depending on the needs of the user.

In some embodiments, the TCA 500 may comprise thermogel material that may expand and compress under the stress of the helmet and continue outputting the cooling aspect of the device. In some implementations, the TCA 500 may comprise strips of the cooling material that may allow for a more comfortable fit when under a helmet with padding. In some aspects, the different TCA caps 500, 501, 502 may interchangeably fit under headwear 520.

Figure 6A:
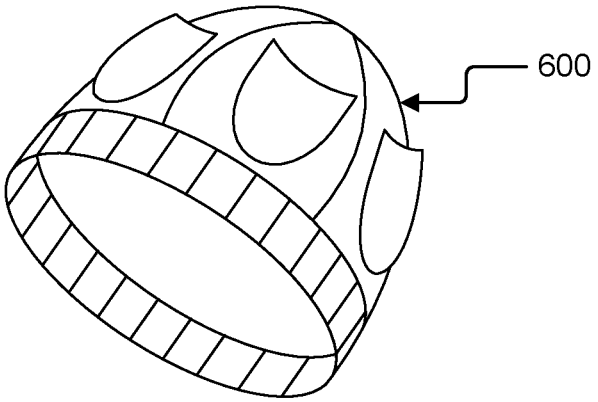
FIG. 6A illustrates exemplary TCA cap, according to some embodiments of the present disclosure.
Figure 6B:
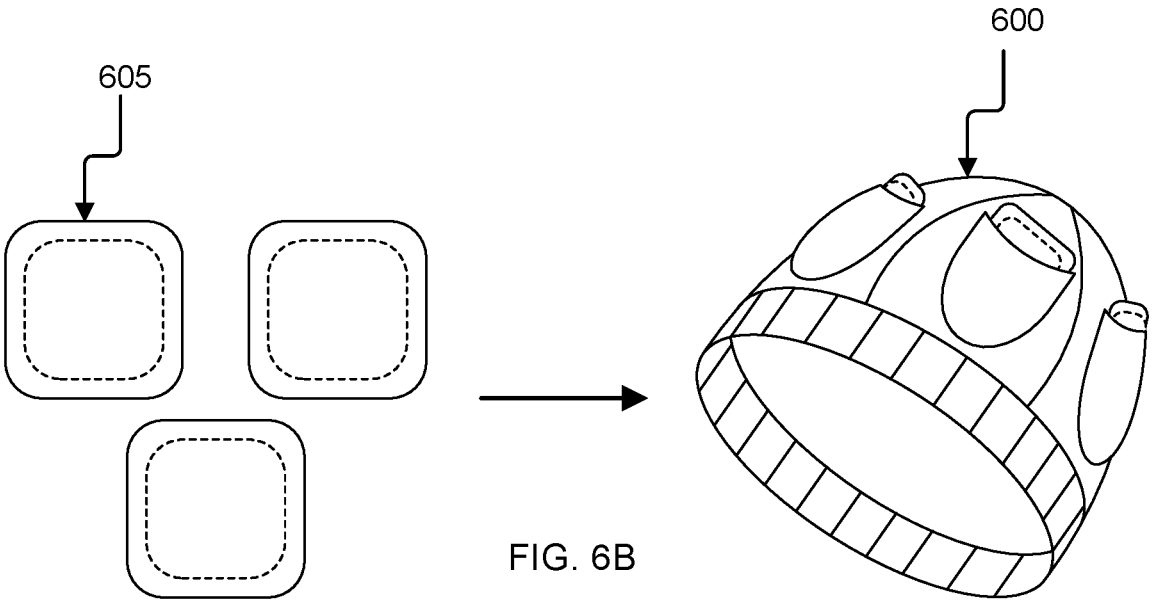
FIG. 6B illustrates exemplary TCA cap, according to some embodiments of the present disclosure.
Figure 6C:
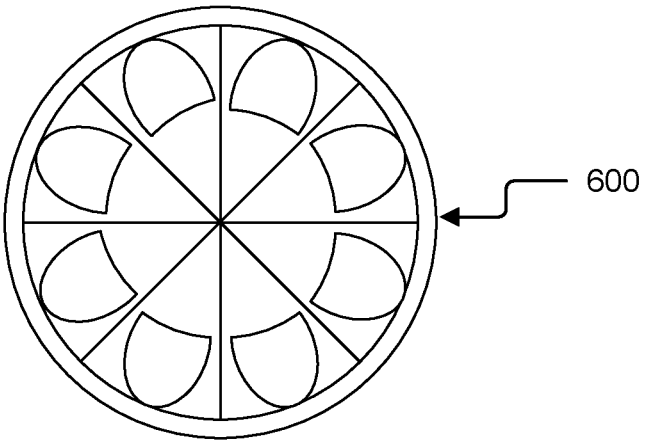
FIG. 6C illustrates exemplary TCA cap, according to some embodiments of the present disclosure.

Referring now to FIG. 6A, exemplary TCA cap 600 is illustrated. Referring now to FIG. 6B, exemplary TCA cap 600 with temperature-retaining pads 605 is illustrated. Referring now to FIG. 6C, exemplary TCA cap 600 with pockets for temperature-retaining pads 605 is illustrated.

In some embodiments, the TCA 600 device is shown with pockets that may be used to place temperature-retaining pads 605 inside the pockets. In some implementations, cooling materials may include, but are not limited to, cooling pods, cooling strips, cooling portions, etc. In some aspects, the TCA 600 cap may have packs of temperature-retaining pads 605 that may be placed in the pockets. In some embodiments, the pockets may be closed and the temperature-retaining pads 605 may be sealed in. In some implementations, the TCA 600 cap may comprise pockets throughout, which may allow for a range of placement for the temperature-retaining pads 605. In some aspects, the pockets may be limited to certain areas of the TCA 600 cap, but the pockets may be customized by the user for comfort.

In some embodiments, the pockets, may be located on the outside of the TCA 600 cap for ease of access to the cooling material to be placed inside. In some implementations, the pockets may be located on the inside of the TCA 600, which may allow for closer contact of the temperature-retaining pads 605 to the skin of the user. In some aspects, the pockets, may be located on the outside of the TCA 600 cap for ease of access to the cooling material to be placed inside.

In some embodiments, the pockets may be located on the inside of the TCA 600 cap for a more secure and comfortable fit within the use inside the helmet. In some implementations, a pocket may be located on top of the TCA 600 cap, which may target the crown of the user's head. In some aspects, the pockets may be secure by hook and look material, snaps, or buttons, as non-limiting examples.

Figure 7A:
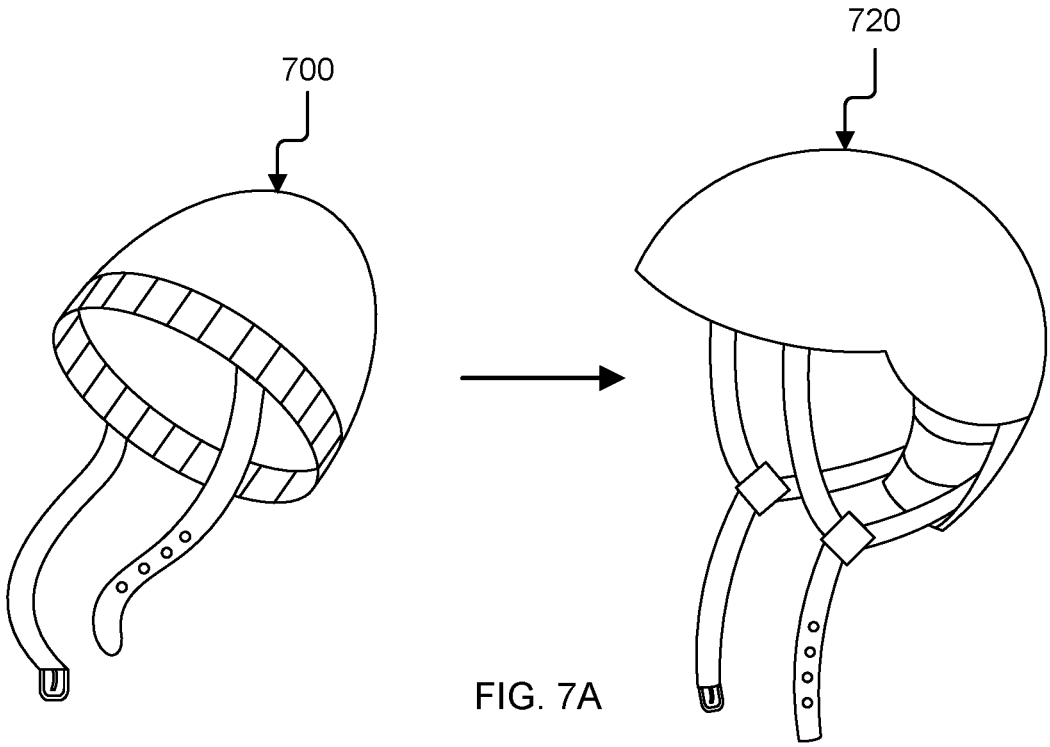
FIG. 7A illustrates headwear with exemplary TCA with straps, according to some embodiments of the present disclosure.
Figure 7B:
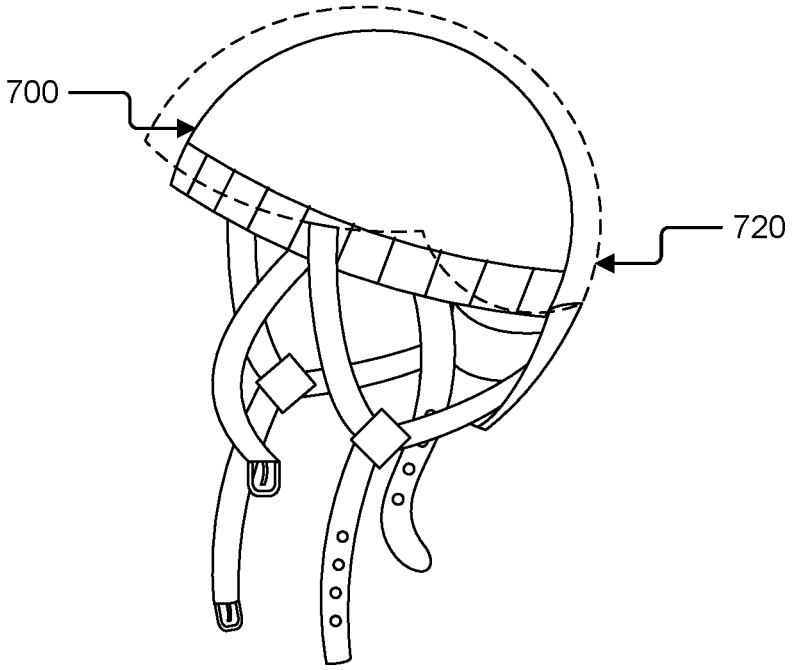
FIG. 7B illustrates headwear with exemplary TCA with straps, according to some embodiments of the present disclosure.

Referring now to FIG. 7A, headwear 720 with exemplary TCA 700 with straps is illustrated. Referring now to FIG. 7B, headwear 720 with exemplary TCA 700 with straps is illustrated. In some implementations, the TCA 700 may come with straps attached to the sides to be worn by itself while still having a secure fit. In some aspects, headwear 720 may comprise football, military, youth, adults, worker's hat, equestrian, fishing, cowboy hat, sombrero, wool hat, or thermal ware, as non-limiting examples.

In some implementations, the straps may be flush with similar headwear such as, but not limited to, riding helmets, cycling helmets, or hockey helmets, as non-limiting examples. In some embodiments, a TCA 700 cap may reflect the disclosure described for FIG. 6 above. In some implementations, a TCA 700 cap may be used by the user when performing excessive movement, working or doing strenuous activities. In some aspects, the strap may limit shifting during use.

In some embodiments, the TCA 700 cap may be longer lasting and more durable than previous versions. In some implementations, the TCA 700 cap may be used for long periods of time and have longer lasting cooling material. For example, this version of the TCA 700 cap may be used for construction workers, military soldiers, and endurance sports, as non-limiting examples. In some aspects, this version may be thicker than the previous versions, which may allow for the TCA 700 cap for longer cooling periods and more durability throughout each use.

Figure 8B:
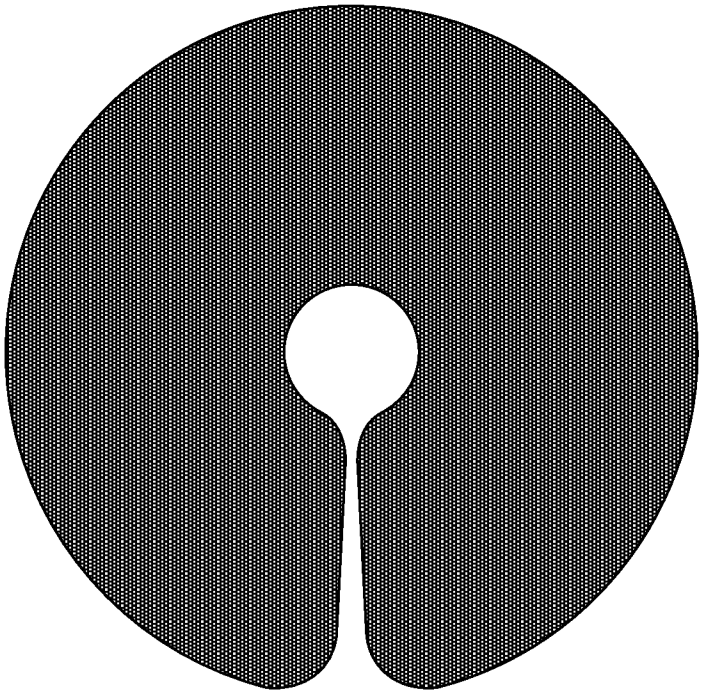
FIG. 8B illustrates headwear with an exemplary TCA insert, according to some embodiments of the present disclosure.
Figure 8A:
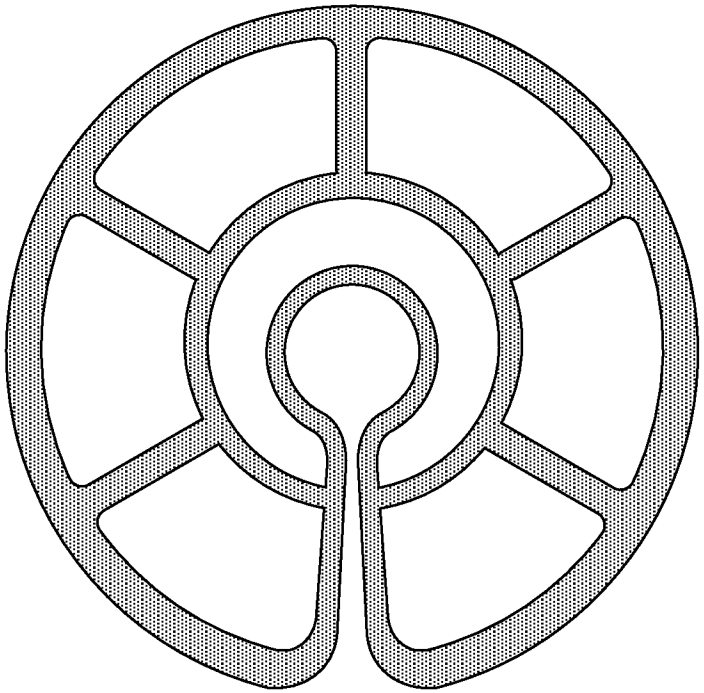
FIG. 8A illustrates an exemplary TCA insert, according to some embodiments of the present disclosure.
Figure 8C:
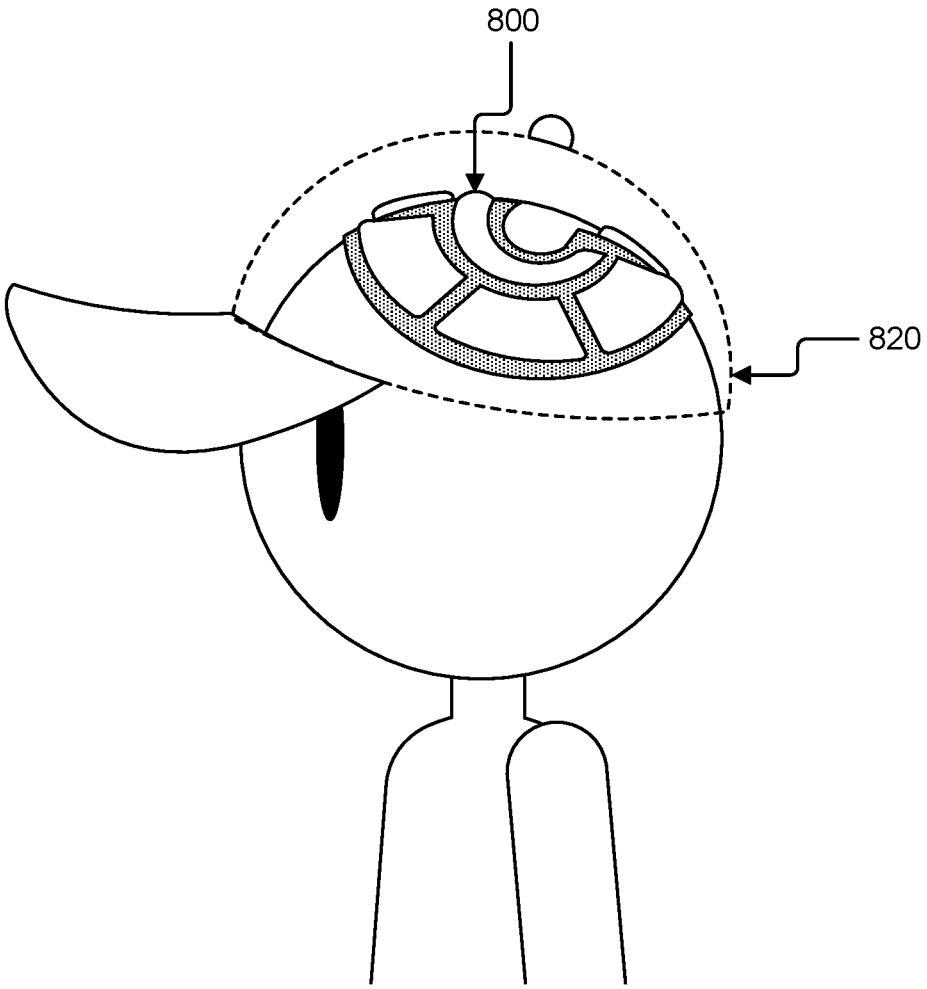
FIG. 8C illustrates headwear with an exemplary TCA insert, according to some embodiments of the present disclosure.

Referring now to FIGS. 8A-8B, an exemplary TCA insert 800 is illustrated. Referring now to FIG. 8C, headwear 820 with an exemplary TCA insert 800 is illustrated. In some aspects, a TCA insert 800 may comprise a panel of cooling segments, which may allow for flexibility of the TCA insert 800. In some embodiments, cooling segments may limit the time required to effectively cool down the TCA insert 800. In some implementations, a TCA insert 800 may comprise a backing that may allow for insertion and attachment into headwear 820. The TCA insert 800 may comprise a soft backing that may sit between the headwear 820 and the user, wherein the fit of the headwear 820 may sufficiently secure the TCA insert 800.

In some aspects, TCA insert 800 may comprise a substantially circular shape with at least one slit or gap located between at least a portion of a plurality of cooling segments. In such embodiments, each cooling segment may take the form of a protrusion projecting outwardly from a circular center portion, with adjacent protrusions being physically separate from one another. By way of example and not limitation, TCA insert 800 may comprise at least three protrusions, with each individual protrusion comprising a curved outer edge and two substantially straight side portions and wherein each protrusion may comprise at least one packet of temperature-retaining material.

Figure 9A:
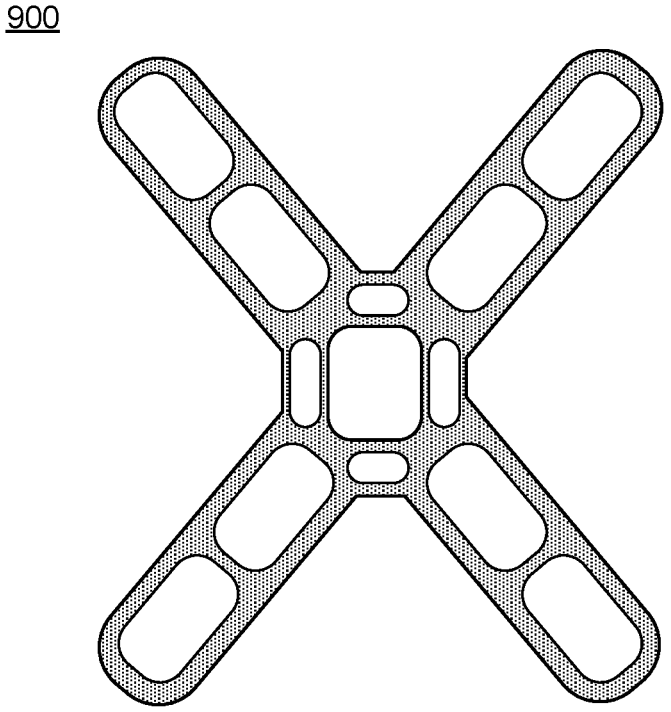
FIG. 9A illustrates an exemplary TCA insert, according to some embodiments of the present disclosure.
Figure 9B:
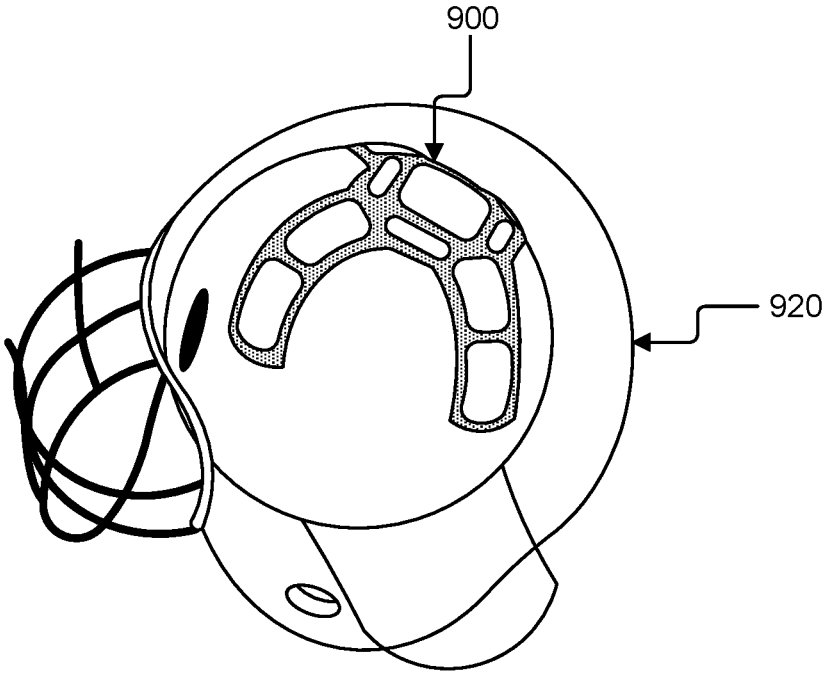
FIG. 9B illustrates headwear with an exemplary TCA insert, according to some embodiments of the present disclosure.

Referring now to FIG. 9A, an exemplary TCA insert 900 is illustrated. Referring now to FIG. 9B, headwear 920 with an exemplary TCA insert 900 is illustrated. In some embodiments, a TCA insert 900 may comprise cooling arms that may extend the TCA insert 900 over multiple areas of the user's head. Cooling arms may allow for extensive coverage of the head without a complete covering, which may alter the fit of the headwear 920. In some aspects, the TCA insert 900 may fit to the headwear 920. For example, a helmet may comprise interior padding, and the TCA insert 900 may secure to the padding or between the padding portions.

Figure 10A:
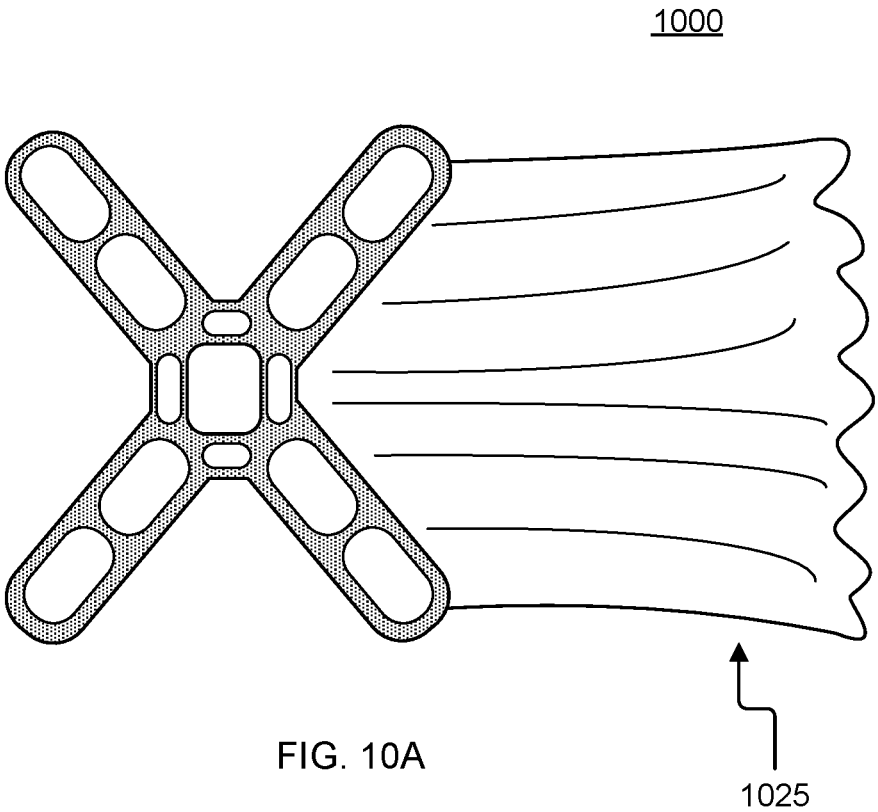
FIG. 10A illustrates an exemplary TCA insert, according to some embodiments of the present disclosure.
Figure 10B:
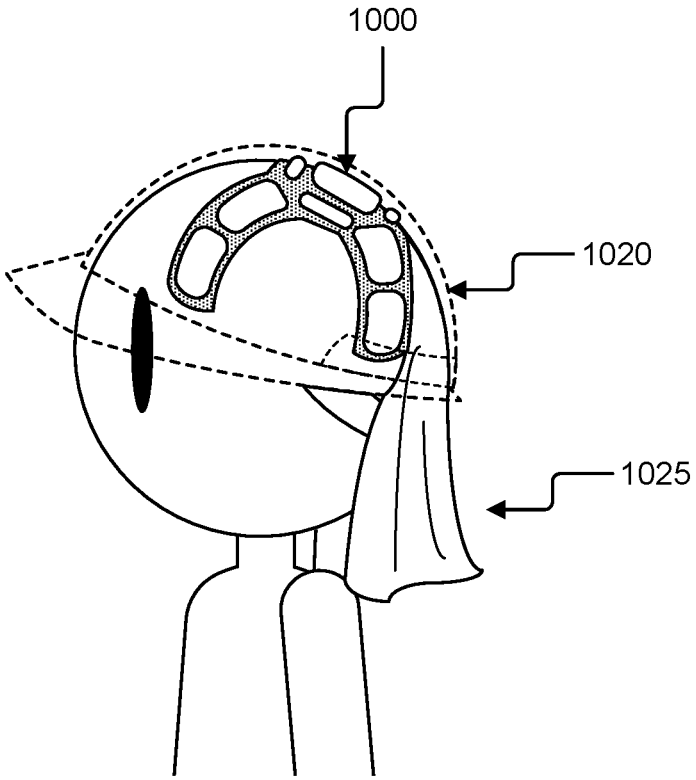
FIG. 10B illustrates headwear with an exemplary TCA insert, according to some embodiments of the present disclosure.

Referring now to FIG. 10A, an exemplary TCA insert 1000 with neck panel 1025 is illustrated. Referring now to FIG. 10B, headwear 1020 with an exemplary TCA insert 1000 with neck panel 1025 is illustrated. In some embodiments, a TCA insert 1000 may comprise a neck panel 1025 that may extend beyond the headwear 1020. In some aspects, the neck panel 1025 may comprise a material that may retain temperature. For example, the material may comprise a fabric that may absorb fluids, such as cold or hot water.

As another example, the material may comprise a similar material as the TCA insert 1000, which may allow for cooling or heating of the entire piece through the same or similar mechanism. For example, both the TCA insert 1000 and the neck panel 1025 may be placed in a freezer to cool both. In some embodiments, the TCA insert 1000 and the neck panel 1025 may comprise different materials. In some aspects, the TCA insert 1000 and the neck panel 1025 may be detachable, which may allow for a user to selectively use the neck panel 1025.

Figure 11A:
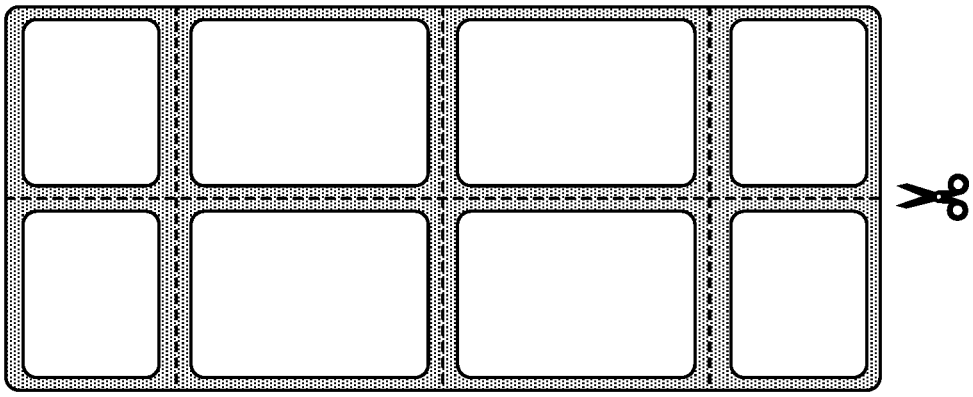
FIG. 11A illustrates a top-down view of an exemplary TCA insert, according to some embodiments of the present disclosure.
Figure 11B:
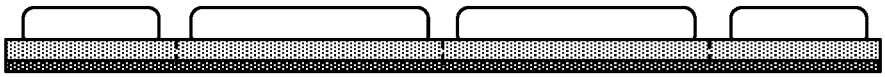
FIG. 11B illustrates a side view of an exemplary TCA insert, according to some embodiments of the present disclosure.

Referring now to FIG. 11A, a top-down view of an exemplary TCA insert 1100 is illustrated. Referring now to FIG. 11B, a side view of an exemplary TCA insert 1100 is illustrated. In some aspects, a TCA insert 1100 may comprise a series of different sized segments. The TCA insert 1100 may comprise cut indicators between the segments, which may allow for customization of the TCA insert 1100. The customization may be based on user size, headwear style, or general preferences.

Figure 12:
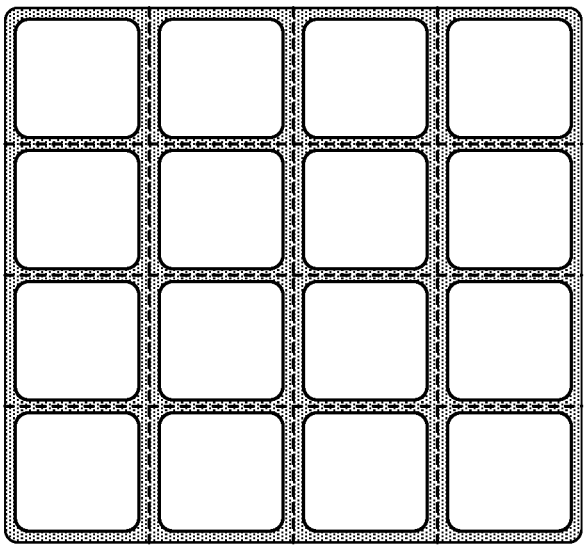
FIG. 12 illustrates an exemplary TCA insert, according to some embodiments of the present disclosure.

Referring not to FIG. 12, an exemplary TCA insert 1200 is illustrated. In some embodiments, a TCA insert 1200 may comprise a series of standard segments. In some aspects, the segments may be cut into different shapes and sizes. For example, a TCA insert 1200 may be cut into arms, such as illustrated in FIG. 9A. Customization may allow for multiple configurations. In some aspects, the different segments may comprise the same or different materials. Where the TCA insert 1200 may comprise different materials, different segments may have different temperature retention abilities, which may allow for multiple uses from the same base TCA insert 1200.

Figure 13A:
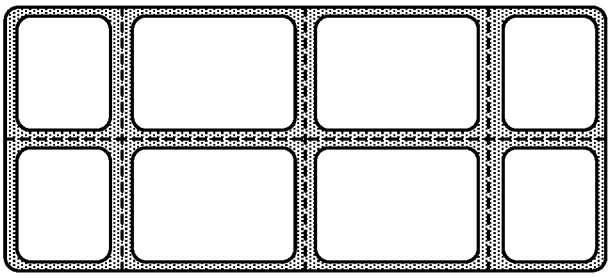
FIG. 13A illustrates an exemplary TCA insert, according to some embodiments of the present disclosure.
Figure 13B:
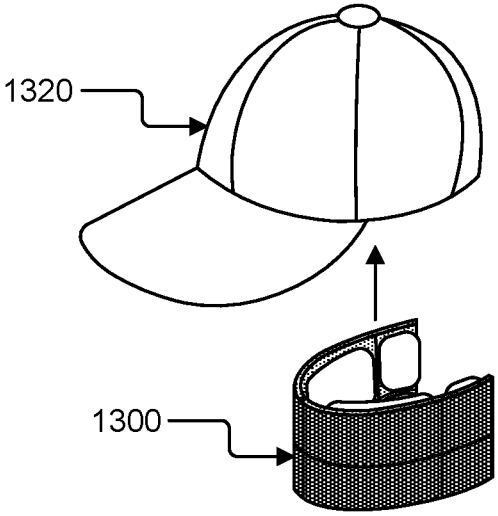
FIG. 13B illustrates headwear with an exemplary TCA insert, according to some embodiments of the present disclosure.
Figure 13C:
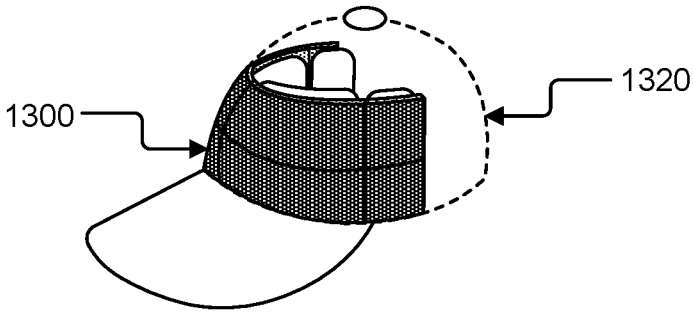
FIG. 13C illustrates headwear with an exemplary TCA insert, according to some embodiments of the present disclosure.
Figure 14A:
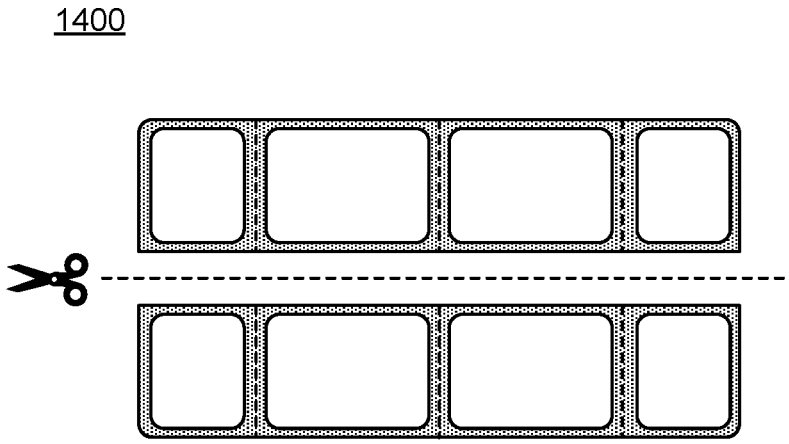
FIG. 14A illustrates an exemplary TCA insert, according to some embodiments of the present disclosure.
Figure 14B:
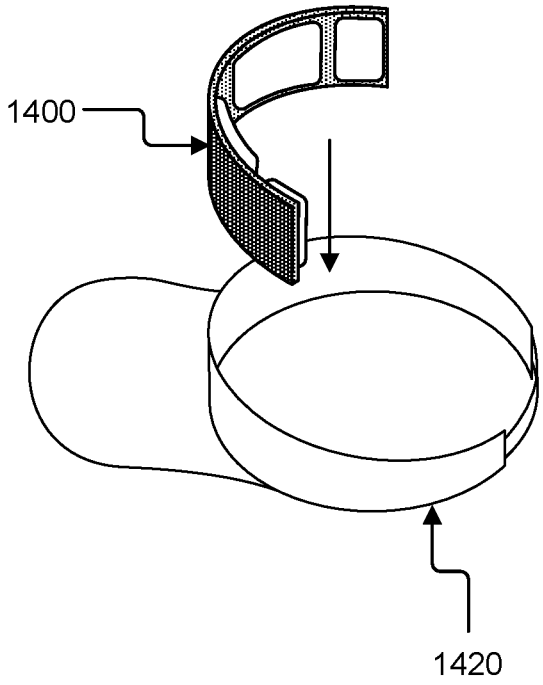
FIG. 14B illustrates headwear with an exemplary TCA insert, according to some embodiments of the present disclosure.

Referring now to FIG. 13A, an exemplary TCA insert 1300 is illustrated. Referring now to FIG. 13B, headwear with an exemplary TCA insert 1300 is illustrated. Referring now to FIG. 13C, headwear 1320 with an exemplary TCA insert 1300. In some aspects, a TCA insert 1300 may comprise multiple segments that may be separate based on need. For example, a larger portion of the TCA insert 1300 may be used in a standard ball cap style headwear 1320. A full TCA insert 1300 may be useful for an adult or someone with a larger sized head. In some aspects, the size Referring now to FIG. 14A, an exemplary TCA insert 1400 is illustrated. Referring now to FIG. 14B, headwear 1420 with an exemplary TCA insert 1400 is illustrated. In some aspects, a TCA insert 1400 may comprise segments. The TCA insert 1400 may comprise perforations that may allow for convenient separation between segments without requiring scissors. The TCA insert 1400 may be cut to fit into headwear 1420 with a thin band, such as a visor or headband.

Figure 15A:
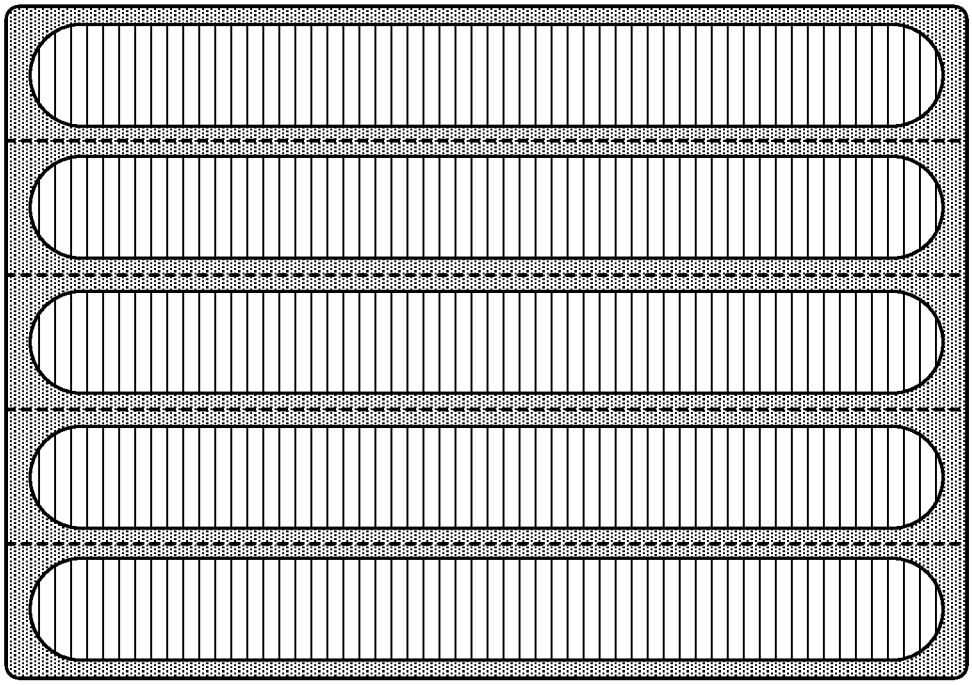
FIG. 15A illustrates a top-down view of an exemplary TCA insert, according to some embodiments of the present disclosure.
Figure 15B:
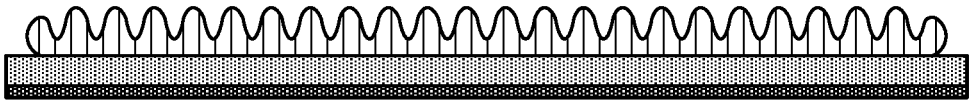
FIG. 15B illustrates a side view of an exemplary TCA insert, according to some embodiments of the present disclosure.

Referring now to FIG. 15A, a top-down view of an exemplary TCA insert 1500 is illustrated. Referring now to FIG. 15B, a side view of an exemplary TCA insert 1500 is illustrated. In some embodiments, a TCA insert 1500 may comprise a textured surface. A textured surface may allow for increased surface area, which may provide more cooling or heating to a user. In some aspects, a textured surface may increase comfort and stability of the TCA insert 1500 within headwear. In some embodiments, a TCA insert 1500 may comprise multiple strips that may be separated by a user based on preference or need, such as fit of the headwear, type of headwear, size of the user's head, or general preference.

Figure 16A:
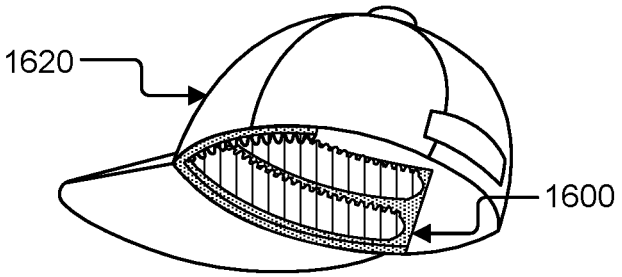
FIG. 16A illustrates an exemplary TCA insert, according to some embodiments of the present disclosure.
Figure 16B:
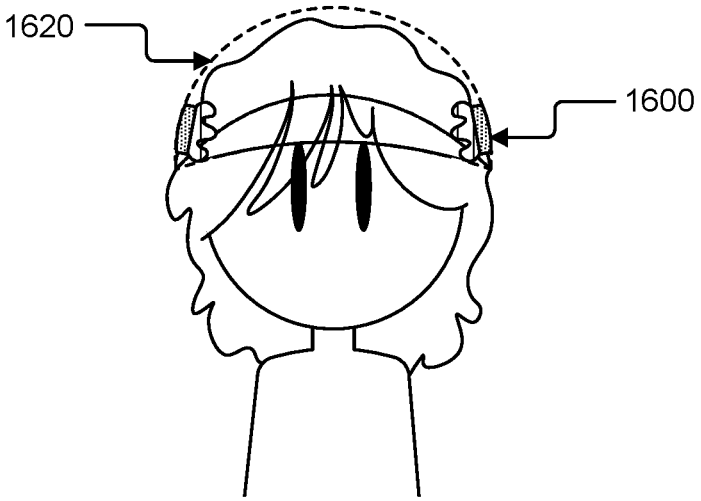
FIG. 16B illustrates headwear with an exemplary TCA insert, according to some embodiments of the present disclosure.
Figure 16C:
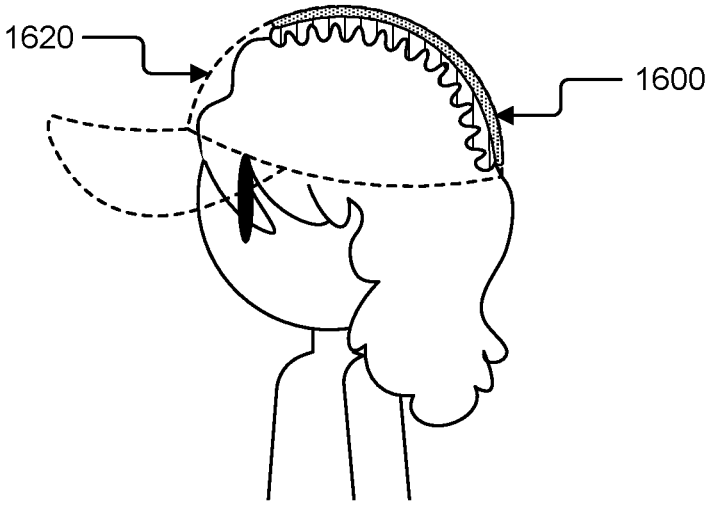
FIG. 16C illustrates headwear with an exemplary TCA insert, according to some embodiments of the present disclosure.

Referring now to FIG. 16A, an exemplary TCA insert 1600 is illustrated. Referring now to FIG. 16B, headwear 1620 with an exemplary TCA insert 1600. Referring now to FIG. 16C, headwear 1620 with an exemplary TCA insert 1600 is illustrated. In some embodiments, a TCA insert 1600 may be placed in multiple locations within headwear 1620. In some aspects, a TCA insert 1600 may be shifted based on current preference, such as around the head or over the head of a user. In some implementations, a TCA insert 1600 may comprise a textured surface, which may allow for the TCA insert 1600 to penetrate hair of the user. This may allow the cooling or heating to reach the head of a user more effectively.

Figure 17A:
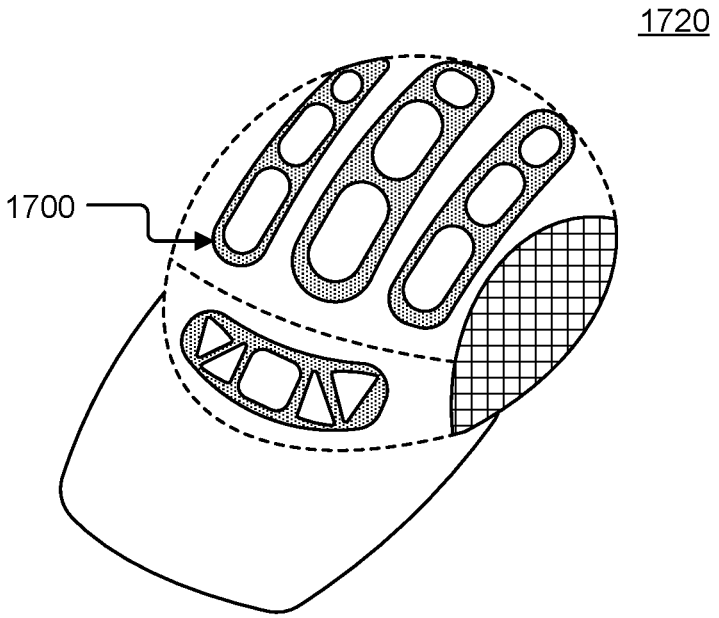
FIG. 17A illustrates a perspective view of an exemplary headwear with TCA insert, according to some embodiments of the present disclosure.
Figure 17B:
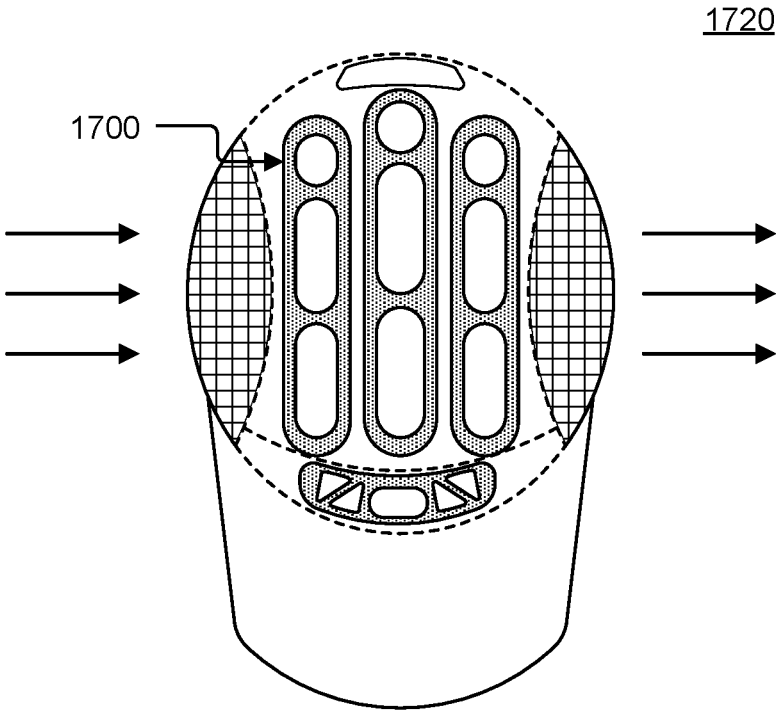
FIG. 17B illustrates a top-down view of an exemplary headwear with TCA insert, according to some embodiments of the present disclosure.

Referring now to FIG. 17A, a perspective view of an exemplary headwear 1720 with TCA insert 1700 is illustrated. Referring now to FIG. 17B, a top down view of an exemplary headwear 1720 with TCA insert 1700 is illustrated. In some embodiments, a TCA insert 1700 may be integrated within the headwear 1720. Integration of the TCA insert 1700 into the headwear 1720 may allow for a better fit of the headwear 1720. A separate TCA insert that is separately added may affect the fit of the headwear 1720. In some implementations, headwear 1720 may comprise other features to supplement the effectiveness of heating or cooling of the TCA insert 1700.

For example, headwear 1720 may comprise netting that increases flow of air through the headwear 1720, which may support cooling. As another example, headwear 1720 may comprise a fleece lining to support heating. In some aspects, headwear 1720 may be adaptable to both heating and cooling. For example, headwear 1720 may comprise a removable fleece panel over netting, which may allow for adjusting warming and cooling features.

In some embodiments, the headwear 1720 may be placed in a freezer, refrigerator, or microwave, as non-limiting examples. In some aspects, the headwear 1720 may comprise a rechargeable power source that may allow for active heating or cooling of the TCA insert 1700. In some implementations, the TCA insert 1700 may comprise a material that may retain temperature when wetted. Where the TCA insert 1700 may be wetted, the headwear 1720 may be waterproof or may also absorb the water adding to the temperature control effectiveness.

Figure 18A:
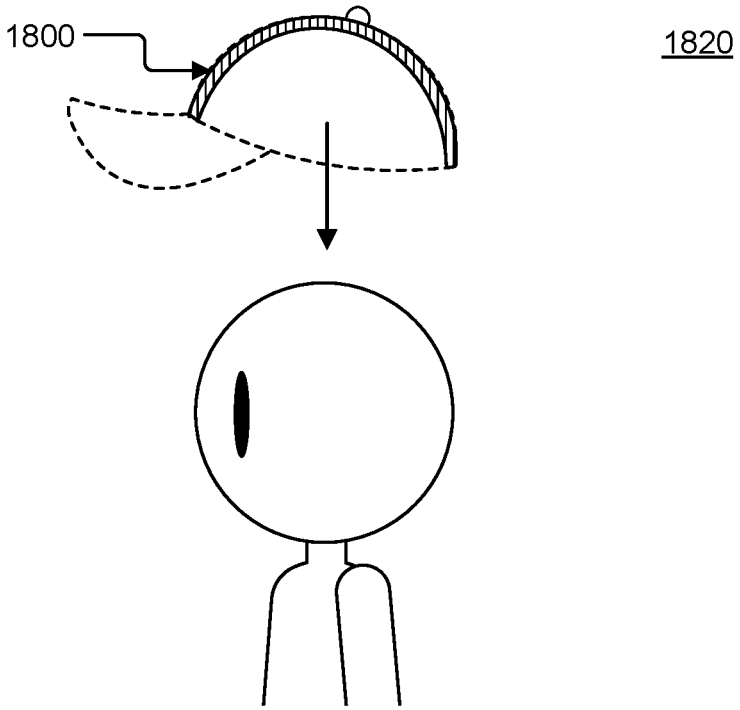
FIG. 18A illustrates an exemplary headwear with TCA insert, according to some embodiments of the present disclosure.
Figure 18B:
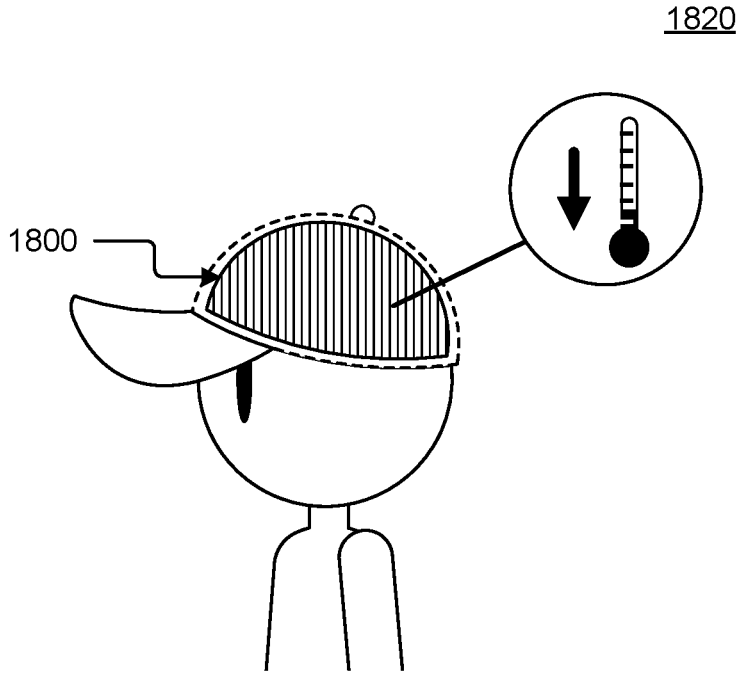
FIG. 18B illustrates an exemplary headwear with TCA insert, according to some embodiments of the present disclosure.

Referring now to FIG. 18A, an exemplary headwear 1820 with TCA insert 1800 is illustrated. Referring not to FIG. 18B, an exemplary headwear 1820 with TCA insert 1800 is illustrated. In some aspects, a TCA insert 1800 may comprise a material that may be activated with pressure. When worn, a TCA insert 1800 may press firmly against a user's head, which may activate the cooling or heating of the material within the TCA insert 1800. The activation may last for a predetermined amount of time depending on a range of factors, such as the comparative temperature of the user, the fit of the headwear, thickness of the TCA insert 1800, or amount of material within the TCA insert 1800, as non-limiting examples.

Figure 19A:
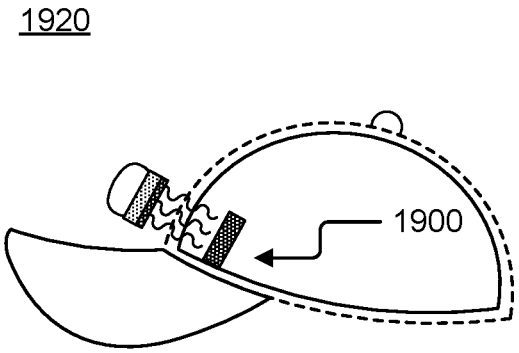
FIG. 19A illustrates an exemplary headwear with TCA insert attachable through a magnetic mechanism, according to some embodiments of the present disclosure.
Figure 19B:
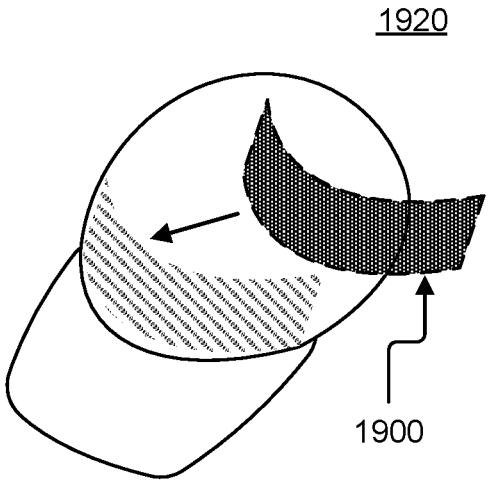
FIG. 19B illustrates an exemplary headwear with TCA insert attachable through a magnetic mechanism, according to some embodiments of the present disclosure.

Referring now to FIG. 19A, an exemplary headwear 1920 with TCA insert 1900, is illustrated, wherein the TCA insert 1900 is attachable through a magnetic mechanism. Referring now to FIG. 19B, an exemplary headwear 1920 with TCA insert 1900 is illustrated, wherein the TCA insert 1900 is attachable through a magnetic mechanism. In some aspects, a TCA insert 1900 may comprise a magnetic backing. In some embodiments, a separate magnetic strip or pieces may be added to the exterior of the headwear 1920 to secure the magnetic backing of the TCA insert 1900 within the headwear 1920. An exterior magnetic piece may limit the thickness that the TCA insert 1900 adds to the headwear.

Exterior magnetic pieces may allow for use and reuse of the TCA inserts 1900. It may also allow for custom placement and positioning of the TCA insert 1900 within multiple types of headwear 1920. The magnetic components of both the backing of the TCA insert 1900 and the exterior piece may be substantial enough to connect through the material of the headwear 1920. In some aspects, the strength of the exterior piece may be interchangeable to allow for different types of material or thicknesses of the headwear 1920.

Figure 20A:
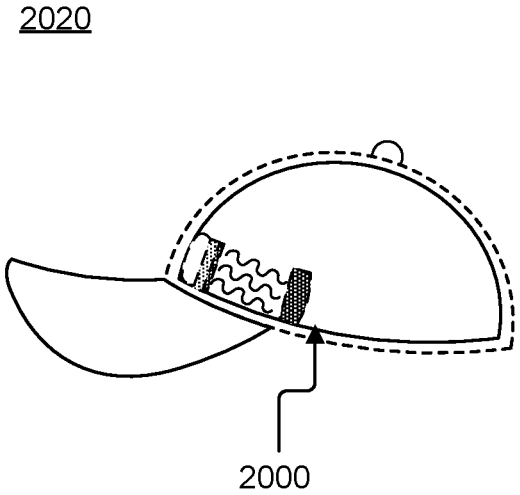
FIG. 20A illustrates an exemplary headwear with TCA insert attachable through a magnetic mechanism, according to some embodiments of the present disclosure.
Figure 20B:
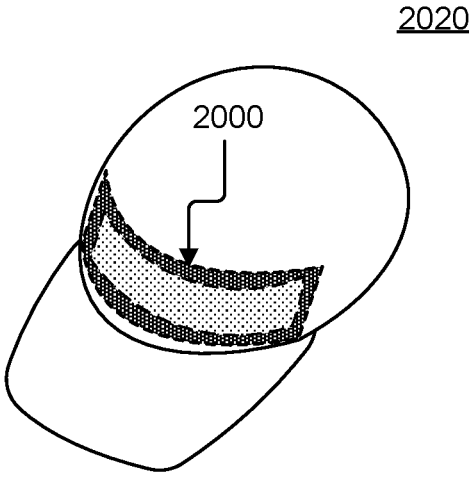
FIG. 20B illustrates an exemplary headwear with TCA insert attachable through a magnetic mechanism, according to some embodiments of the present disclosure.

Referring now to FIG. 20A, an exemplary headwear 2020 with TCA insert 2000 is illustrated, wherein the TCA insert 2000 is attachable through a magnetic mechanism. Referring now to FIG. 20B, an exemplary headwear 2020 with TCA insert 2000 is illustrated, wherein the TCA insert 2000 is attachable through a magnetic mechanism. In some aspects, headwear 2020 may comprise an interior magnetic panel, which may allow for direct connection of a TCA insert 2000 with magnetic backing. In some embodiments, the interior magnetic panel may be flexible and thin to allow for comfort of the headwear 2020.

Figure 21:
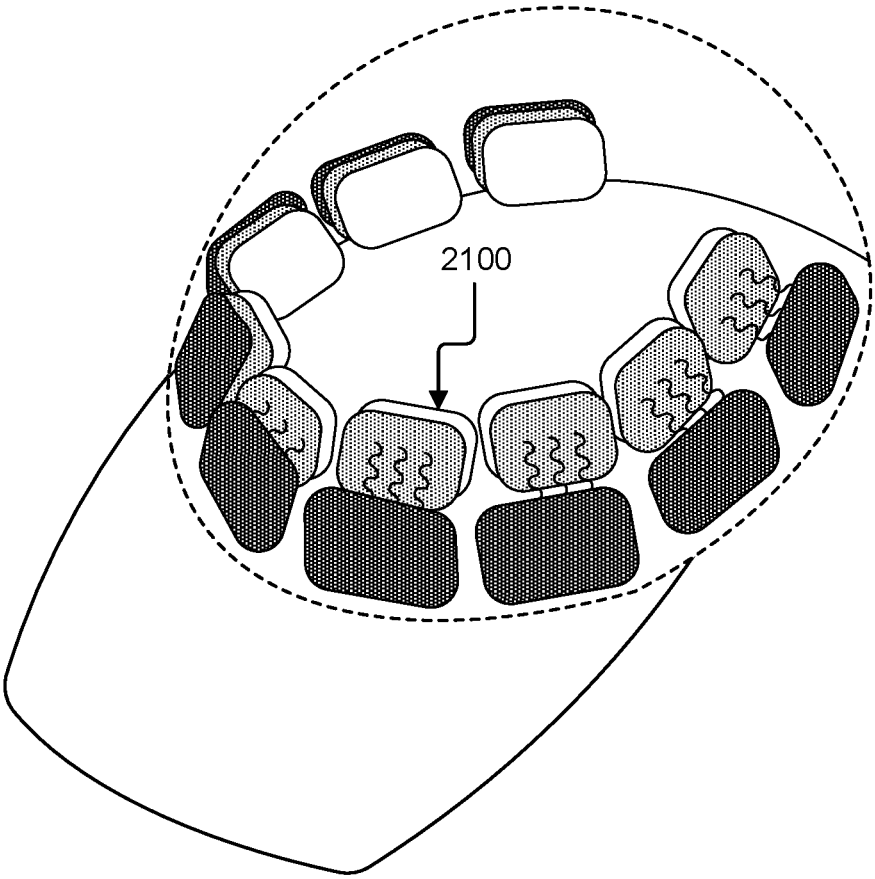
FIG. 21 illustrates an exemplary headwear with TCA insert attachable through a magnetic mechanism, according to some embodiments of the present disclosure.

Referring now to FIG. 21, an exemplary headwear 2120 with TCA insert 2100 is illustrated, wherein the TCA insert 2100 is attachable through a magnetic mechanism. In some aspects, headwear 2120 may comprise a series of magnetic pieces throughout the interior. In some embodiments, a TCA insert 2100 may comprise multiple pieces or segments that may individually attach to the headwear 2120.

Having multiple magnetic pieces within the headwear 2120 may allow for dynamic placement of the TCA insert 2100. For example, a user may move the TCA insert 2100 based on preference or current need, such as based on a haircut, hairstyle, or temperature type of cooling or heating, as non-limiting examples. In some implementations, a TCA insert 2100 may originally comprise a strip or a plurality of segments that may be cut or separated by a user, such as illustrated in FIGS. 11A-15B.

CONCLUSION

A number of embodiments of the present disclosure have been described. While this specification contains many specific implementation details, these should not be construed as limitations on the scope of any disclosures or of what may be claimed, but rather as descriptions of features specific to particular embodiments of the present disclosure.

Certain features that are described in this specification in the context of separate embodiments can also be implemented in combination or in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A headwear with temperature control apparatus comprising:

a wearable apparel for removably wearing on a head of a user, wherein the wearable apparel comprises:

a head covering that covers at least a portion of the head when the wearable apparel is worn, an opening configured to receive the head into the head covering, and a securing mechanism that secures the wearable apparel to the head; and a temperature control apparatus integrated with at a least a portion of the head covering and proximate to the head when worn, wherein the temperature control apparatus is configured to control a temperature of the head, and wherein the temperature control apparatus comprises a unitary and substantially circular shape comprising a plurality of interconnected protrusions projecting outwardly from a circular center portion, wherein adjacent protrusions are physically separate from one another.

2. The headwear of claim 1, wherein the temperature control apparatus comprises a temperature-retaining material distributed throughout the wearable apparel.

3. The headwear of claim 2, wherein the temperature-retaining material is activated by placement of the headwear in a freezer.

4. The headwear of claim 1, wherein the wearable apparel comprises a skull cap.

5. The headwear of claim 4, wherein the skull cap is insertable into a secondary headwear.

6. The headwear of claim 5, wherein the secondary headwear comprises protective headwear.

7. A temperature control apparatus for use in a headwear, wherein the temperature control apparatus comprises:

a temperature control apparatus comprising a soft backing configured to removably integrate with the headwear, wherein the temperature control apparatus comprises a unitary and substantially circular shape comprising a plurality of interconnected protrusions projecting outwardly from a circular center portion, wherein adjacent protrusions are physically separate from one another, wherein the headwear comprises:

a wearable apparel for removably wearing on a head of a user, wherein when integration of the temperature control apparatus allows for temperature control of at least a portion of the head when the user wears the wearable apparel, and wherein the wearable apparel comprises:

a head covering that covers at least a portion of the head when the wearable apparel is worn, and an opening configured to receive the head into the head covering.

8. The apparatus of claim 7, wherein the temperature control apparatus comprises at least one packet of temperature-retaining material within each protrusion, wherein the temperature control apparatus comprises at least three protrusions, wherein each protrusion comprises a curved outer edge and two substantially straight side portions.

9. The apparatus of claim 8, wherein the temperature control apparatus comprises an activation mechanism, wherein activation prompts temperature control.

10. The apparatus of claim 7, wherein the temperature control apparatus comprises an insertable strip comprising a plurality of pockets of temperature-retaining material.

11. The apparatus of claim 10, wherein the insertable strip is customizable to fit a plurality of head sizes and headwear styles.

12. The system of claim 7, wherein the temperature control apparatus is configured to activate with predefined pressure caused when the headwear is worn on the head.

13. A temperature control system for use in a headwear, wherein the temperature control system comprises:

a temperature control apparatus comprising a unitary and substantially circular shape comprising a plurality of interconnected protrusions projecting outwardly from a circular center portion, wherein adjacent protrusions are physically separate from one another, and a soft backing configured to removably integrate with the headwear; and wherein the headwear comprises:

a wearable apparel for removably wearing on a head of a user, wherein when integration of the temperature control apparatus allows for temperature control of at least a portion of the head when the user wears the wearable apparel, and wherein the wearable apparel comprises:

a head covering configured to cover at least a portion of the head when the wearable apparel is worn, and an opening configured to receive the head into the head covering.

14. The system of claim 13, wherein the wearable apparel comprises a ball cap.

15. The system of claim 13, wherein the temperature control apparatus comprises a plurality of protrusions connectable to at least a portion of the wearable apparel.

16. The system of claim 15, wherein at least a portion of the wearable apparel comprises hook and loop material, and each of the plurality of protrusions comprise a hook and loop backing connectable to the hook and loop material.

17. The system of claim 13, wherein the temperature control apparatus comprises an insertable headband, wherein when inserted into the wearable apparel, the temperature control apparatus is configured to wrap around a forehead of the user.

18. The system of claim 17, wherein the insertable headband is configured to be adjustable to one or both a headwear style and size of the head.

19. The system of claim 13, wherein the temperature control apparatus is configured to activate with predefined pressure caused when the headwear is worn on the head.

* * * * *